US009700158B1

(12) United States Patent
Reed

(10) Patent No.: US 9,700,158 B1
(45) Date of Patent: Jul. 11, 2017

(54) ROTATABLE PEDESTAL COMPONENTS AND ASSEMBLIES

(71) Applicant: PEDESTAL DESIGNS, INC., Boise, ID (US)

(72) Inventor: Petra Reed, Boise, ID (US)

(73) Assignee: PEDESTAL DESIGNS, INC., Boise, ID (US)

( * ) Notice: Subject to any disclaimer, the term of this patent is extended or adjusted under 35 U.S.C. 154(b) by 0 days.

(21) Appl. No.: 14/842,755

(22) Filed: Sep. 1, 2015

Related U.S. Application Data

(63) Continuation-in-part of application No. 14/010,187, filed on Aug. 26, 2013, now Pat. No. 9,119,486.

(60) Provisional application No. 61/693,045, filed on Aug. 24, 2012.

(51) Int. Cl.
*A47B 91/00* (2006.01)
*A47F 5/10* (2006.01)
*A47F 5/00* (2006.01)

(52) U.S. Cl.
CPC ..... *A47F 5/106* (2013.01); *A47F 5/0018* (2013.01)

(58) Field of Classification Search
CPC ..... A47B 2087/023; A47B 87/02; A47B 87/0246; A47B 17/065; A47B 11/00; A47B 13/003; A47B 46/00; A47B 91/00; E04G 3/00
USPC ..... 248/349.1, 282.1, 346.01, 274.1, 576.1, 248/283.1, 416, 418, 425; 211/49.1, 53, 211/56, 70, 131.1, 131.2, 144, 163, 164, 211/196, 205, 65, 66; 297/344.24; 108/59, 92, 93, 94, 97, 101, 103
See application file for complete search history.

(56) References Cited

U.S. PATENT DOCUMENTS

| | | | |
|---|---|---|---|
| 198,050 | A | 12/1877 | Scott |
| 243,567 | A | 6/1881 | Ireland |
| 283,090 | A | 8/1883 | Farnum |
| 554,661 | A | 2/1896 | Dolittle |
| 1,213,690 | A | 1/1917 | Quinones |
| 1,298,762 | A | 4/1919 | Milligan |
| 1,331,862 | A | 2/1920 | Claus |
| 1,437,867 | A | 12/1922 | Sixta |
| 1,443,420 | A | 1/1923 | Lennox |

(Continued)

FOREIGN PATENT DOCUMENTS

| | | | |
|---|---|---|---|
| WO | 2007114933 | A2 | 10/2007 |
| WO | 2007123782 | A2 | 11/2007 |

OTHER PUBLICATIONS

International Search Report, International Application No. PCT/US2007/08444, Applicant: Pedestal Designs Inc., Date of mailing: Jul. 30, 2008.

(Continued)

*Primary Examiner* — Janet M Wilkens
(74) *Attorney, Agent, or Firm* — Pedersen and Company, PLLC; Ken J. Pedersen; Barbara S. Pedersen

(57) ABSTRACT

Display pedestals comprise at least one generally planar horizontal support member, and at least one vertical column. The top surface and/or the bottom surface of the support member has least one depression or at least one projection, and at least one vertical column fits to the depression or projection. Multiple columns may be arranged in, and rotatable and detachable in, pillars that support multiple top and intermediate support members, so that the pedestal is modular and adjustable by rotation into many different configurations.

9 Claims, 19 Drawing Sheets

(56) References Cited

U.S. PATENT DOCUMENTS

| | | | |
|---|---|---|---|
| 1,870,005 | A | 8/1932 | Gutsch |
| 2,023,300 | A | 12/1935 | Barnett |
| 2,119,821 | A | 6/1938 | Manley |
| D118,463 | S | 1/1940 | West |
| 2,204,319 | A | 6/1940 | Parsons et al. |
| 2,239,156 | A | 4/1941 | Lewis |
| 2,377,904 | A | 6/1945 | Roach |
| 2,692,107 | A | 10/1954 | De Ridder et al. |
| 2,696,356 | A | 12/1954 | Baumann |
| 2,883,764 | A | 4/1959 | Stephens |
| 3,091,361 | A | 5/1963 | Gawron |
| 3,131,656 | A | 5/1964 | Houle |
| 3,161,986 | A | 12/1964 | Stubbmann et al. |
| 3,176,676 | A | 4/1965 | Caldwell |
| 3,538,862 | A | 11/1970 | Patriarca |
| D221,781 | S | 9/1971 | Caigan |
| 3,654,877 | A | 4/1972 | Barrett |
| 3,736,714 | A | 6/1973 | Brenner |
| 3,741,404 | A | 6/1973 | Jourdain |
| 3,756,169 | A | 9/1973 | Dybvig |
| 3,858,495 | A | 1/1975 | Gotwalt |
| 3,878,796 | A | 4/1975 | Morrison |
| 3,942,654 | A | 3/1976 | Warrick |
| 4,147,007 | A | 4/1979 | Eppich |
| 4,169,417 | A | 10/1979 | Gemvik |
| 4,181,281 | A | 1/1980 | Kosak |
| 4,220,099 | A | 9/1980 | Marchesano |
| 4,316,634 | A | 2/1982 | Roesler |
| 4,397,246 | A | 8/1983 | Ishida et al. |
| 4,424,753 | A | 1/1984 | Eatherton |
| 4,511,034 | A | 4/1985 | Pan |
| D287,677 | S | 1/1987 | Pomeroy et al. |
| 4,687,167 | A | 8/1987 | Skalka et al. |
| 4,760,802 | A | 8/1988 | Leong |
| 4,761,930 | A | 8/1988 | Tepera |
| 4,781,643 | A | 11/1988 | Holloway et al. |
| 4,798,361 | A | 1/1989 | Fawcett |
| 4,841,879 | A | 6/1989 | Ferguson |
| 4,841,880 | A | 6/1989 | Ferguson |
| 4,955,490 | A | 9/1990 | Schäfer |
| D321,101 | S | 10/1991 | Zucker |
| 5,101,737 | A | 4/1992 | Gomez |
| D328,536 | S | 8/1992 | Ma |
| 5,269,231 | A | 12/1993 | Johnson |
| 5,272,990 | A | 12/1993 | Carter |
| 5,353,716 | A | 10/1994 | Wilbert |
| 5,425,198 | A | 6/1995 | Coy |
| 5,425,314 | A | 6/1995 | MacFarland |
| 5,440,998 | A | 8/1995 | Morgan et al. |
| 5,487,345 | A | 1/1996 | Winebarger et al. |
| 5,537,937 | A | 7/1996 | Juvik-Woods |
| 5,577,344 | A | 11/1996 | Zaremba et al. |
| 5,662,048 | A | 9/1997 | Kralj et al. |
| 5,676,251 | A | 10/1997 | Credle |
| 5,687,653 | A | 11/1997 | Bumgarner |
| 5,718,178 | A | 2/1998 | Smith |
| 5,785,530 | A | 7/1998 | Smith |
| 5,829,602 | A | 11/1998 | St. John Danko |
| 5,830,032 | A | 11/1998 | Campbell |
| 5,842,425 | A | 12/1998 | Van Der Aa |
| 5,887,513 | A | 3/1999 | Fielding et al. |
| 5,967,056 | A | 10/1999 | Plante |
| 5,971,830 | A | 10/1999 | Tobin |
| 5,996,819 | A | 12/1999 | Klein |
| 5,996,820 | A | 12/1999 | Broadnax |
| 6,039,192 | A | 3/2000 | Hollander |
| 6,041,719 | A | 3/2000 | Vidal et al. |
| 6,095,468 | A | 8/2000 | Chirico et al. |
| 6,158,360 | A | 12/2000 | Cheng |
| 6,182,841 | B1 | 2/2001 | Klein |
| D446,043 | S | 8/2001 | Stoppenhagen et al. |
| 6,314,869 | B1 | 11/2001 | Bourgeois, Jr. |
| D453,372 | S | 2/2002 | Pecoskie |
| 6,345,466 | B1 | 2/2002 | Venanzi |
| 6,360,884 | B1 | 3/2002 | Smith et al. |
| 6,505,804 | B1 | 1/2003 | Francis et al. |
| 6,688,573 | B2 | 2/2004 | Reed et al. |
| 6,877,442 | B2 | 4/2005 | Helle |
| 6,915,994 | B2 | 7/2005 | Oddsen |
| 6,938,558 | B1 | 9/2005 | Peres |
| 7,004,437 | B2 | 2/2006 | Bauer et al. |
| 7,399,090 | B2 | 7/2008 | Oda |
| 7,407,144 | B2 | 8/2008 | Reed et al. |
| 7,490,561 | B1 | 2/2009 | Chou |
| 7,673,843 | B2 * | 3/2010 | Reed ..... A47F 5/16 248/282.1 |
| 7,722,005 | B2 | 5/2010 | Reed et al. |
| 7,798,076 | B1 * | 9/2010 | Neff ..... A47B 87/02 108/157.13 |
| 7,856,933 | B2 | 12/2010 | Miller et al. |
| 7,922,492 | B2 | 4/2011 | Nielsen et al. |
| 8,127,696 | B2 | 3/2012 | Reed et al. |
| 8,286,563 | B2 | 10/2012 | Low |
| 8,943,983 | B2 | 2/2015 | Reed et al. |
| 9,119,486 | B2 | 9/2015 | Reed |
| 2003/0007321 | A1 | 1/2003 | Dayley |
| 2003/0104098 | A1 | 6/2003 | Schrader |
| 2004/0164653 | A1 | 8/2004 | Winkless |
| 2004/0226490 | A1 | 11/2004 | Polumbaum |
| 2004/0226492 | A1 | 11/2004 | Carter |
| 2005/0081764 | A1 | 4/2005 | Michaels et al. |
| 2005/0166804 | A1 | 8/2005 | Hansen |
| 2006/0096508 | A1 | 5/2006 | Herring |
| 2008/0011206 | A1 | 1/2008 | Warriner |
| 2008/0066657 | A1 | 3/2008 | Kuo |
| 2008/0163801 | A1 | 7/2008 | Gamba et al. |

OTHER PUBLICATIONS

International Search Report, International Application No. PCT/US2007/08041, Applicant: Pedestal Designs Inc., Date of mailing: Aug. 26, 2008.

International Preliminary Report on Patentability, Application No. PCT/US2007/008444, Applicant: Pedestal Designs Inc., Date of issuance: Oct. 8, 2008.

International Preliminary Report on Patentability, Application No. PCT/US2007/008041, Applicant: Pedestal Designs Inc., Date of issuance: Mar. 3, 2009.

* cited by examiner

ROTATABLE PEDESTAL COMPONENTS AND ASSEMBLIES

This application is a continuation-in-part of Non-Provisional application Ser. No. 14/010,187, filed Aug. 26, 2013, and issued as U.S. Pat. No. 9,119,486 on Sep. 1, 2015, which claims priority from, and the benefit of, provisional application No. 61/693,045 filed Aug. 24, 2012, the entire contents of which non-provisional and provisional applications are incorporated herein by reference.

BACKGROUND

Field of the Invention

This invention relates to pedestals. The term "pedestal" is used herein to denote a structure which can be placed on a surface, often a horizontal surface, for example on the earth, on the floor of a building, or on an elevated surface (for example a buffet or other table, sideboard, desk or the floor of a shop window) and which will support objects (e.g. tableware of all kinds, foodstuffs for consumption, jewelry, merchandise for sale, and other objects being displayed for commercial and/or aesthetic purposes) placed on top of, or at intermediate levels of, the pedestal. For example, pedestals are widely used in the catering and hospitality industry to support serving dishes, containers, platters, trays, jugs, glasses, bottles, cutlery, ice sculptures, decorations, toiletries, cosmetics, computer screens and/or other computer equipment, and flower vases at positions chosen for functional (e.g. sale of merchandise) and/or decorative reasons.

SUMMARY OF THE INVENTION

The pedestals referred to in this specification comprise one or more generally horizontal components, referred to herein as "supports", "support members", or "horizontal support members", and a plurality of pillars comprising one or more generally vertical components, referred to herein as "columns". The term "vertical axis" is used herein in relation to a column to denote a vertical line which passes through the center of gravity of the column. The references herein to vertical, horizontal, top, bottom, upper and lower assume that the pedestal is being used normally. However, the invention includes the possibility that the pedestal is in a different orientation, and the terms vertical and horizontal are used to include variations from the strictly vertical and strictly horizontal directions which do not have any substantial effect on the function of the components.

As the supports in a pedestal become wider and/or longer and/or thicker, they become heavier, and, therefore, more difficult to handle. Certain embodiments provide a solution to this problem by making use of a support which is effectively "hollow" in that some or all of its interior volume is filled with air or another lightweight material, for example a foamed polymeric or metallic material, which may be a recycled material. The interior volume can also comprise reinforcing ribs which are connected between opposite parts of the periphery, and which may form a grid.

I have discovered, in accordance with the present invention, novel pedestals; novel pedestal components which can be assembled, optionally with known pedestal components, into novel pedestals; novel kits containing pedestal components; novel methods for making pedestals; and novel methods of displaying objects on pedestals.

The invention comprises a modular system of pedestal components that may be fit together to provide a versatile and effective pedestal for a wide variety of uses and environments. The preferred gravitational "securement" of the components to each other may be further stabilized (especially horizontal/side-ways) by mating engagement that comprises loosely-mating, or frictionally- or interference-mating. The modular system may utilize a limited number of component styles/types that are interchangeable in a variety of positions in the pedestal and that are rotational/pivotal relative to each other to provide many different pedestal configurations. The preferred components are at least one size of horizontal support, and at least one size of vertical columns With the preferred at least one size of horizontal support, and with the preferred multiple sizes of columns (preferably, multiple lengths), a great many pedestal configurations may be created of multiple "layers" and multiple connected "stacks" in a single pedestal assembly. Certain supports may be adapted to serve in intermediate layers of the pedestal by having recesses/projections for cooperating with columns both above and below the support. Certain of the supports may be adapted to serve in a top layer by having recesses/projections only on the bottom surface of the support, for cooperating with column(s) below the support, while preferably having a continuous planar upper surface.

In certain embodiments, for example "non-fixed-column" embodiments, all or most of the supports and columns are rotatable/pivotal and detachable relative to each other. This minimizes the number of different component types needed for a given pedestal, maximizes the adjustability of the pedestal configurations, and maximizes the compactness of the pedestal components when disassembled for transport or storage. The supports and columns may be hollow in certain embodiments, solid in certain other embodiments, or mixed hollow and solid components. For example, supports and/or columns may be hollow or partially hollow, to reduce weight and/or to allow manufacture from materials or pre-existing components that are easily adapted to the preferred support or column forms.

Alternatively, but less preferably, all or most of the columns are fixed to a support, for example, by fastening or integral formation. Typically, such "fixed-column units" or "support-with-fixed column(s) units" comprise one or more columns fixed/integral with the support above it. Such units may be built and adjusted into many pedestal configurations, but may require more component types to achieve the same configurations as the non-fixed-column embodiments. This is because the columns are fixed to the support and hence column lengths for a given support are not changeable. Also, such units will occupy substantially more space during transport or storage, as the generally planar or entirely planar supports are not detachable from the columns, and transport or storage will involve stacking or nesting of the components that is not as efficient or compact as disassembling all or most of the columns from the supports. The support-with-fixed-column units may be hollow in certain embodiments, solid in certain other embodiments, or mixed hollow and solid components. For example, the support and/or columns of such units may be hollow or partially hollow, to reduce weight and/or to allow manufacture from materials or pre-existing components that are easily adapted to the preferred support or column forms, for example.

In a first aspect of certain embodiments having hollow or partially-hollow supports, a substantially planar horizontal support comprises:

(1) an upper member which has a substantially continuous planar upper surface, (2) a lower member which has a substantially continuous planar lower surface, and (3) a substantially continuous peripheral member which secures the upper and lower members together, the upper and lower members and the peripheral member defining between them a volume which extends over at least part of the area defined by the periphery of the support, and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface;

In a second aspect of certain embodiments, a pedestal comprises:

(1) a horizontal support according to the first preferred aspect of the invention, and (2) a vertical column which fits into the depression in the horizontal support or which fits over the projection extending from the horizontal support.

The pedestal can comprise in certain embodiments, a mixture of hollow/partially-hollow supports and solid supports. For example, in addition to one or more horizontal supports according to said first aspect and one or more vertical columns which fit into a depression or fit over a projection on a horizontal support of said first aspect, one or more additional horizontal supports which are not horizontal supports according to said first aspect (for example, solid supports) and one or more additional columns which do not fit into a depression or over a projection on a horizontal support according to said first aspect. The additional horizontal supports may comprise one or more depressions and/or projections to which the additional vertical columns are fitted. The hollow/partially-hollow and solid supports may appear the same, or substantially the same, on the outside, and the choice of hollowness versus solid may be made based on size and/or materials, for example.

In some pedestals, the components of the pedestal are secured together only by gravitational forces (optionally including gravitational forces resulting from the objects on the pedestal), preferably with stabilization (especially horizontal/sideways) by mating engagement as mentioned above. In some pedestals, one or more of the columns used with a support are fixed with the support in a single unit, but preferably said unit is secured to other units of the same type, or to non-fixed columns and supports, only by gravitational forces (optionally including gravitational forces resulting from the objects on the pedestal). It will be understood from this disclosure, that support-with-fixed-column units and non-fixed columns and supports may be mixed and mingled in a given pedestal if desired.

In a third aspect of certain embodiments, a kit is provided that contains components for assembling one or more pedestals as described herein. The components of a kit can be packed into any suitable container, optionally having compartments for different components, for example a compartmented cart having wheels, a box or a bag, e.g. a cardboard box or a fabric bag. It will be understood from this disclosure that the non-fixed columns and supports will be particularly and beneficially conducive to being provided, transported, and stored in a kit form, as the supports are preferably substantially or entirely planar and can be stacked to be against, or very close to, each other (with little or no wasted space between them), and the columns may also be stacked or lined-up to be against, or very close to, each other (with little or no wasted space between them).

In a fourth aspect of certain embodiments, a method of making a pedestal according to the above-mentioned second aspect comprises assembling at least one column and at least one horizontal support so that they are secured to each other. In one embodiment, the components of the pedestal are assembled and "secured" to each other by the use of manual forces only (i.e. without the use of tools), and preferably the securement is by gravitational forces only.

Optionally, in embodiments, friction or interference fit between columns and support recesses/projections, and/or hand-operated and/or tool-operated fasteners, may be used. In non-fixed column embodiments, said optional friction/interference, and/or optional fasteners. are preferably detachable/removable, so that the columns may be detached and removed from the horizontal support members easily for rearrangement and/or storage of the pedestal components. In support-with-fixed-column embodiments, said optional friction/interference, and/or optional fasteners, are preferably not detachable/removable, or at least detachable/removable only with concerted efforts or with tools, so that the unit is used, moved and stored without the columns becoming detached.

In a fifth aspect, a method of displaying objects is provided which comprises placing the objects on a pedestal, for example, according to one or more of the above-mentioned aspects.

In especially-preferred embodiments, both top support members and intermediate support members are provided. Intermediate support members are those that are between column(s) that are above and below said intermediate support member. Top support members are those that have column(s) only below the top support member and so typically have their entire upper surface available for display. In especially-preferred embodiments, most or all the support members, whether intermediate or top support members are elongated to increase display surface area, and to place columns below and/or above the support member at significantly distanced locations relative to each other, for example, at opposite ends of the elongated support members. For example, it is typically desirable that top and also intermediate support members are at least twice as long (end-to-end) as they are wide, and more preferably 2-10, or 2-20, times as long as wide. And, it is desirable that the top and also intermediate support members are much thinner than they are long (and consequently also thinner than they are wide), for example, a thickness that is in the range of 1/10 to 1/40 of the length of the support member.

The preferred elongation of both the top support members and intermediate support members, and the distancing apart of the pillars (and the columns of the pillars) that support and position the top and intermediate support members, adapts the pedestal so that the support members may be rotated relative to each other, into many different positions relative to each other and relative to the platform surface on which the pedestal rests. For example, rotating a 2 foot long, 4 foot, or 10 foot support member 180 degrees, about a column axis at or near one end of the support member, can move the other end (outer end) of the support member and the corresponding column (at said outer end) up to almost two times the length of the support member, or almost 4 feet, 8 feet, or 20 feet, respectively, away from their original position. This is because the support member can rotate in a circle wherein the outer end moves circumferentially on a radius almost as long as the support member length, that is, in a circle with a diameter almost twice the support member length.

Some or all columns that compose a given pillar, for supporting horizontal support members, may be coaxial, that is, having coincident vertical axes. Some or all columns that compose a given pillar may be positioned so that their vertical axes are not coaxial, that is, so that they are offset from each other. This may include an upper column vertical axis being offset but within a boundary corresponding to and upending from the periphery of the lower column, or offset to a greater extent to be outside of the said boundary of said periphery. Such offset columns may contribute to the adjustability, the aesthetic appeal, and/or the functional effectiveness, of the pedestal configurations.

The preferred top support members are each supported by two pillars that comprise columns below the top support members that engage the top support members at selected locations along the length of the top support member. Also, the preferred intermediate support members are each supported by two pillars that comprise columns below and also above the intermediate support member that engage the intermediate support member at selected locations of the upper surface and the lower surface of said intermediate support member. For example, the locations of engagement of the support member (top and/or intermediate support member) may be at or near opposite ends of the support member, or distanced from the opposite ends in more central locations. For example, "at or near opposite ends" in this context may mean the endmost 30 percent of the end-to-end length of the support member, or more preferably the endmost 20 percent or even the endmost 10 percent of the end-to-end length of the support member. The columns, in coaxial-vertical-axes embodiments, are typically nearer the end extremities of the support than the center of the support. In offset-axes embodiments, one or more of the columns of a given pillar is/are typically at the end extremities and one or more of the columns of the given pillar are closer to, or at, the transverse centerline of the support member.

In especially-preferred embodiments, multiple top support members and multiple intermediate support members are used, and multiple or all of each support member type are elongated and rotatable relative to each other. Preferably, the support members are rotatable relative to each other by being rotatable relative to the columns above and/or below them, which may also mean the columns between the support members. Alternatively and less preferably, the rotation is provided by fixed-column units being rotatable relative to the unit(s) above and/or below them.

Due to the elongated nature and rotatability of the preferred support members, pedestals built from a given number and given styles of components, for example, a set, predetermined number and array of components, may be transformed into many, very different configurations and uses. Use of said multiple intermediate support members and multiple top support members can provide pedestals that, overall, are complex, long, and/or wide; have many turns, curves, branches, and/or layers; and/or that fit a space or event, for example, a particular room, business, residence, corridor, corner, table set-up, banquet size, and/or amount of merchandize or other display items.

BRIEF DESCRIPTION OF THE DRAWINGS

The invention is illustrated by the accompanying drawings, which are diagrammatic and not to scale, and in which.

DETAILED DESCRIPTION

Figure 1:
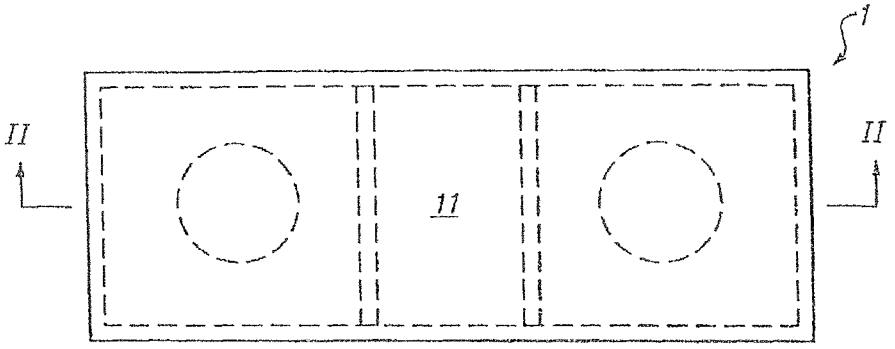
FIG. 1 is a plan view of one embodiment of a horizontal support of the invention.

In the Summary and the Detailed Description, and in the accompanying drawings, reference is made to particular features of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

The term "comprises" and grammatical equivalents thereof are used herein to mean that other elements (i.e. components, ingredients, steps etc.) are optionally present. For example, a pedestal "comprising" (or "which comprises") components A, B and C can contain only components A, B and C, or can contain not only components A, B and C but also one or more other components. The term "at least" followed by a number is used herein to denote the start of a range beginning with that number (which may be a range having an upper limit or no upper limit, depending on the variable being defined). For example "at least 1" means 1 or more than 1. When, in this specification, a range is given as "(a first number) to (a second number)" or "(a first number)-(a second number)", this means a range whose lower limit is the first number and whose upper limit is the second number. For example, "from 0.2 to 5 inches" or "0.2-5 inches" means a range whose lower limit is 0.2 inches, and whose upper limit is 5 inches. The terms "plural" and "plurality" are used herein to denote two or more than two items.

Where reference is made herein to "first" and "second" elements, this is often done for identification purposes; unless the context requires otherwise, the first and second elements can be the same or different, and reference to a first element does not mean that a second element is necessarily present (though it may be present). Where reference is made herein to "a" or "an" element, this includes the possibility that there are two or more such elements (except where the context excludes that possibility). Where reference is made herein to two or more elements, this includes the possibility that the two or more elements are replaced by a lesser number or greater number of elements providing the same function (except where the context excludes that possibility). The numbers given herein should be construed with the latitude appropriate to their context and expression; for example, each number is subject to variation which depends on the accuracy with which it can be measured by methods conventionally used by those skilled in the art.

First Aspect of Certain Embodiments

The horizontal support of the first aspect can be of any size and shape which enables the support to provide desired functions in a pedestal. For example, it can have one or more of (i.e. any possible combination of two or more of) the following optional characteristics:

(1) In plan view, the support has a shape which is rectangular (including square), rectangular with rounded corners, polygonal, circular, oval or other regularly curved shape.

(2) The upper member has a planar upper surface which is free from depressions and projections, and the lower member has a substantially planar lower surface which comprises one or more depressions or one or more projections.

(3) The upper member has a substantially planar upper surface which comprises one or more depressions or one or more projections, and the lower member has a planar lower surface which is free from depressions and projections.

(4) The upper member has a substantially planar upper surface which comprises one or more depressions, and the lower member has a substantially planar lower surface which comprises one or more depressions.

(5) The horizontal support comprises a depression which does not extend between the upper and lower surfaces.

(6) The upper member comprises a first depression which does not extend between the upper and lower surfaces and the lower member comprises a second depression which does not extend between the upper and lower surfaces, the first and second depressions being coincident when the horizontal support is viewed in plan.

(7) The upper member comprises a first depression and the lower member comprises a second depression, the first and second depressions being coincident when the horizontal support is viewed in plan and communicating with each other, and there is a horizontal lip which lies between the first and second depressions and which extends inwards from the peripheries of the depressions. The horizontal lip prevents a column inserted into either of the depressions from passing through to the opposite side of the support member.

(8) The horizontal support comprises a depression whose periphery is circular or polygonal, for example a hexagon or an octagon, or a rectangle with rounded corners. The depression can have a base which is flat or a base which comprises relatively small irregularities which make it easier for a column placed in the depression to rotate relative to the depression. In some embodiments, the depression has an annular shape when viewed in plan, the outer periphery of the annular shape being circular or polygonal, for example a hexagon or an octagon, and the inner periphery of the annular shape being the same as or different from the shape of the outer periphery. When the depression has an outer periphery which is a circle or a rectangle with rounded corners, it can cooperate with a column having a circular cross-section so that the column can rotate within the depression. Alternatively, the depression can have a shape, for example a rectangle or a polygon, which cooperates with a column having a corresponding shape so that the column cannot rotate in the depression. The depression can also include components that will cooperate with corresponding components on a column, for example twist-fit components, so that the column is positively engaged in the depression and cannot be removed without positive measures to disengage the respective components. The use of such components will normally, but not necessarily, result in the column being secured to the support in a way which prevents it from being rotated relative to the support.

(9) The horizontal support comprises a projection whose periphery is circular or polygonal, for example a hexagon or an octagon. When the projection is circular, it can cooperate with a column having a circular periphery so that the column can rotate relative to the support. When the projection is polygonal, it can cooperate with a column having a corresponding periphery so that the column cannot rotate relative to the support; alternatively, it can cooperate with the column having a circular periphery which fits between the innermost surfaces of the polygon.

(10) The upper surface and/or the lower surface comprises a continuous planar surface and one or more projections which are secured to the continuous planar surface, the projections being permanently secured to the continuous planar surface, for example by an adhesive or by welding.

(11) The upper surface and/or the lower surface comprises a continuous planar surface and one or more projections which are removably secured to the continuous planar surface, for example by magnetic or pneumatic forces, said continuous planar surface optionally being provided with markings for locating the one or more removable projections on one or more locations on the continuous planar surface.

(12) Each of the upper and lower surfaces is a continuous planar surface except for any depressions therein.

(13) The upper surface is a continuous planar surface except for the one or more depressions and/or projections, and the lower surface is a continuous planar surface.

(14) The lower surface is a continuous planar surface except for the one or more depressions and/or projections, and the upper surface is a continuous planar surface.

(15) The horizontal support has a uniform thickness, for example a thickness of 0.5 to 10 inch, or 1 to 10 inch, e.g. 2 to 5 inch.

(16) The horizontal support has an area, viewed in plan, of 1 to 100 $ft^2$, for example 4 to 40 $ft^2$, e.g. 4 to 20 $ft^2$.

(17) The horizontal support has a volume of at least ½ $ft^3$, e.g. at least ⅔ $ft^3$.

(18) The horizontal support has a volume of less than 8 $ft^3$, e.g. less than 6 $ft^3$.

(19) The horizontal support has a volume of 1 to 6 $ft^3$, e.g. at least 1 to 4 $ft^3$.

(20) In certain embodiments comprising hollow interior space(s), at least part of the interior volume of the interior space(s) of the support is filled with air or another gas.

(21) In certain embodiments comprising hollow interior space(s), at least part of the interior volume of the interior space(s) of the support is filled with a foamed polymeric material having a density which is at most 0.2 times, preferably at most 0.1 times, e.g. 0.01 to 0.1 times, the density of the upper and lower members.

(22) In certain embodiments comprising hollow interior space(s), the interior volume of the support is filled with a foamed metallic material having a density which is at most 0.2 times, preferably at most 0.1 times, e.g. 0.01 to 0.1 times, the density of the upper and lower members.

(23) Each of the upper and lower members is composed of metal, aluminum, composite, wood, cardboard, paper, polymer, recycled or new materials, other materials, or combinations of these materials.

(24) Each of the upper and lower members is composed of a polymeric material.

(25) At least part of the support is composed of injection-molded polymeric material.

(26) In certain embodiments comprising hollow interior space(s), the interior volume of support comprises one or more ribs which extend between the periphery of the support.

Second Aspect of Certain Embodiments

The pedestals of the invention comprise:

(1) at least one horizontal support according to said first aspect; and (2) at least one vertical column which fits into a depression in the horizontal support or which fits over a projection extending from the horizontal support.

The vertical column can be of any size and shape which enables it to fit into the depression in the horizontal support or to fit over the projection extending from the horizontal support. The column may have a constant cross-section, or the column can have a constant cross-section apart from a terminal portion of different cross-section at one or both ends. The column may have one or more of (i.e. any possible combination of two or more of) the following optional characteristics.

(1) At least part of the column has a constant annular cross-section, when viewed in plan. It may, for example, a tube having one or more sections removed from it to make it lighter and/or easier to handle and/or to enable additional components to be located on the tube.

(2) At least part of the column has a constant annular cross-section when viewed in plan and fits into a depression in the horizontal support which has (a) a cross-section whose periphery is circular and slightly larger than the diameter of the column, in which case the column can rotate in relation to the horizontal support, or (b) a cross-section which is rectangular and preferably has a semicircular ends, with the shorter dimension of the rectangle being slightly larger than the diameter of the column and the rounded corners and the preferable semicircular ends having a diameter slightly larger than the diameter of the column, in which case the column can move both laterally and rotationally in relation to the horizontal support. The column may, for example, be a tube having one or more sections removed from it to make it lighter and/or easier to handle and/or to enable additional components to be located on the tube.

(3) At least part of the column has a constant annular cross-section when viewed in plan, and the column fits over a projection extending from the horizontal support, the projection having a cross-section which is circular with a diameter which is a little less than the diameter of the inner periphery of the annular column, or the projection having a noncircular cross-section which fits within the annular column. In both cases, the column can move rotationally in relation to the horizontal support. The column may, for example, a tube having one or more sections removed from it to make it lighter and/or easier to handle and/or to enable additional components to be located on the tube.

(4) At least one end of the column has a cross-section which is not circular and which is fitted into a depression which is not circular and which prevents the column from rotating in relation to the support.

(5) In some embodiments, the column is no longer than is necessary to provide a connection, for example a rotatable connection, between two support members, i.e. has a length which is substantially equal to the sum of the depths of the recesses in the supports which the column connects (in which case the column is not an important part of the visual appearance of the pedestal). Generally, however, at least one of the columns (or multiple, or even the majority or all) has/have a substantial length, for example at least 2.5 inch or at least 4 inch, for example, 2.5 to 36 inch or 10 to 36 inch. The length of the column can be, for example, from 0.5 to 5 times the effective diameter of the column (the term "effective diameter" being used to denote the diameter of a cylindrical column or, for a non-cylindrical column of constant cross-section, the diameter of a circle having the same cross-sectional area as a non-cylindrical column).

The preferred pedestals of the invention may consist essentially of first and second vertical columns and the horizontal support between them. Generally, however, the first and second vertical columns and the horizontal support form part of a larger pedestal. In some embodiments, the pedestal comprises at least one horizontal support which is rotatably connected to at least one column. The pedestal can include a component which fits to a depression or projection on the support member and to the base or the top of a column, and thus forms a connection to a support member and a column which would not otherwise fit together. The height of such a component can be small, e.g. 1-3 inch or about 2.5 inch, for example so that the distance between the support member and the column is minimal.

Some pedestals of the invention comprise a column which extends upwards from the horizontal support and is a hollow tube whose upper periphery comprises at least two pairs, preferably at least four pairs, of open channels into which support members can be fitted, for example as described in U.S. Pat. No. 6,688,573 and U.S. Pat. No. 7,722,005, which are incorporated by reference herein.

Some pedestals of the invention comprise two spaced-apart columns which extend upwards from the horizontal support, and the upper ends of the columns comprise at least two pairs, preferably at least four pairs, of open channels into which support members can be fitted, for example as described in U.S. Pat. No. 7,407,144 which is incorporated by reference herein.

Some pedestals of the invention comprise a first column which has a first axis and which fits rotatably into a recess or over a projection on the lower surface of the support, and a second column which has a second axis and which fits rotatably into a recess or over a projection of the upper surface of the support. Certain embodiments comprise the first vertical axis lying within the periphery of the second column but not coinciding (not coaxial) with the second vertical axis. Certain embodiments comprise the first axis coinciding (being coaxial) with the second vertical axis.

In multiple-layer pedestal portions (also called "stacks" herein), the vertical axis of a first column is also in many embodiments the vertical axis of rotation relative to a lower support and/or upper support. The first column may be coaxial with a second vertical axis of a second column, or may be laterally offset from the second vertical axis, including laterally offset but within the periphery (outer extent, circumference, radial boundary) of the second column and/or laterally offset but outside the periphery of the second column.

In certain embodiments, wherein the second vertical axis of the second column is offset from the first vertical axis but not within the periphery of the second column, the first and second columns and their respective axes may be greatly offset, for example, anywhere ranging from location(s) at or near the transverse centerline CL of the cooperating support member, to at or near the end of the support opposite said first columns and its first vertical axis. Having columns at or near opposite ends of the supports, rather than at the center of the support, is preferred, as this increases the amount of open upper horizontal surface of the support that is available for receiving displayed objects.

In certain embodiments, pedestals of the invention comprise two relatively short columns and one relatively long column cooperating with two supports. Specifically:

(1) a first lower vertical column having a top and a bottom and a first lower vertical axis, (2) a first upper vertical column having a top and a bottom and a first upper vertical axis which is coincident/coaxial with the first lower vertical axis, (3) a second vertical column having a top and bottom;

(4) a first intermediate horizontal support, the top of the first lower vertical column being fitted to a recess or projection in the lower surface of the first horizontal support and the bottom of the first upper vertical being fitted to a recess or projection in the upper surface of the first horizontal support, (5) a second upper horizontal support according to the first aspect of the invention, the top of the first upper vertical column being fitted to a recess or projection in the lower surface of the second horizontal support and the top of the second vertical column being fitted to a recess of projection in the lower surface of the second horizontal support.

Preferably all the connections between the horizontal supports (for example, the first intermediate support and the second upper horizontal support) and the columns (for example, said first lower vertical column, first upper vertical column, and said second vertical column) are rotatable connections. In other embodiments, however, one or more of the columns may be fixed to the support(s), for example, the first lower vertical column being fixed with the first intermediate horizontal support, or the first upper vertical column and/or the second vertical column being fixed with said second upper horizontal support. Alternatively, the first upper vertical column could be fixed with the first intermediate horizontal support, but this is less preferred, as supports with depending columns (rather than upending columns) are more preferred for fixed embodiments. As in many embodiments of the invention, the columns used in the pedestals described in this paragraph are preferably the same except for being two lengths, as that reduces the number of components the user keeps in inventory, but alternatively, the columns may be different, for example, different diameters, different outer wall shapes, different end shapes, different colors, and/or different materials. The first upper vertical column and the first lower vertical column are preferably the same diameter and length, corresponding generally to the distance desired between the first intermediate support and the second upper horizontal support. The second vertical column is preferably the same diameter as the first upper vertical column and the first lower vertical column, but is over twice the length, for example, twice the length plus the thickness of the first intermediate support at the recesses. This will typically correspond to twice the length of the shorter column plus ¼-¾ of the thickness of the first intermediate support.

A kit comprising components for a plurality of separate pedestal bases, and other components, may be assembled into a wide variety of pedestals of different functionalities, shapes, dimensions and decorative appearances. The preferred embodiments make it possible for users to transport a kit of relatively small dimensions to a catering or display event, and to construct, on site, one or more pedestals adapted to the particular requirements of the event. The components are preferably such that, after the event, they can be easily disassembled, cleaned (for example in commercial washing facilities) and repacked as a compact kit for transport to storage or to another event.

FIGS. 1-15

Figure 2:
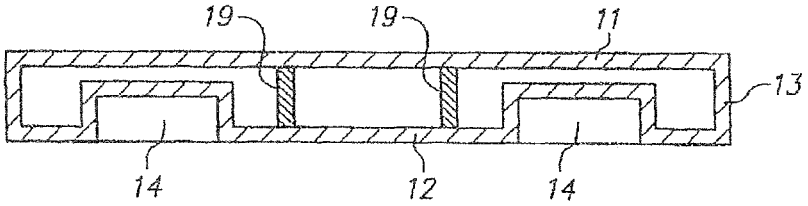
FIG. 2 is a cross-section on line II-II of FIG. 1.
Figure 3:
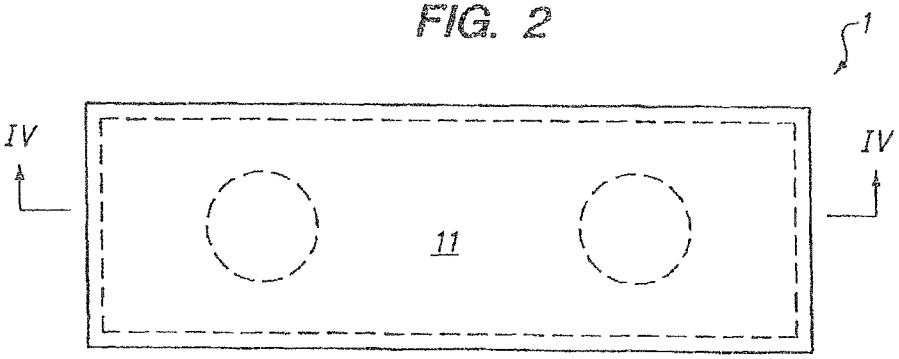
FIG. 3 is a plan view of another embodiment of a horizontal support of the invention.
Figure 4:
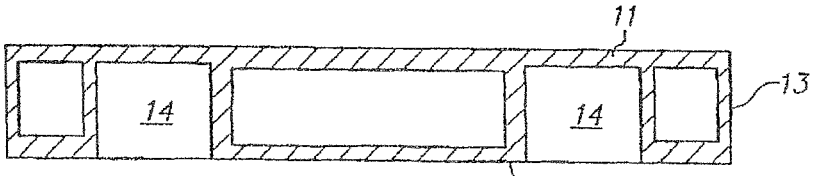
FIG. 4 is a cross-section on line IV-IV of FIG. 3.
Figure 5:
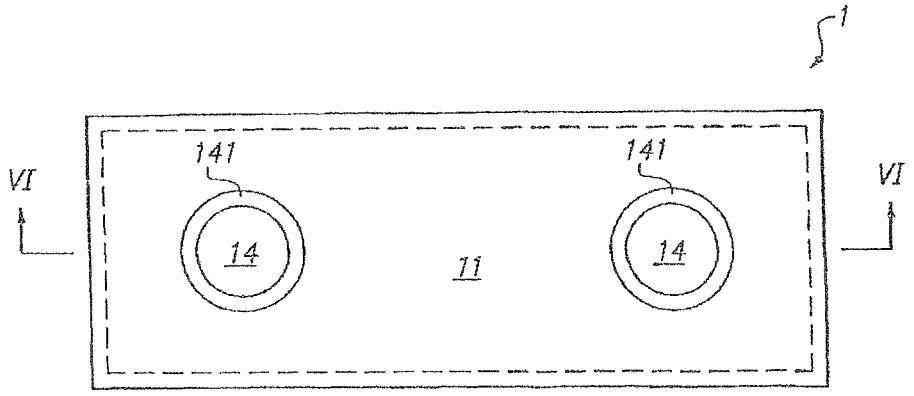
FIG. 5 is a plan view of another embodiment of a horizontal support of the invention.
Figure 6:
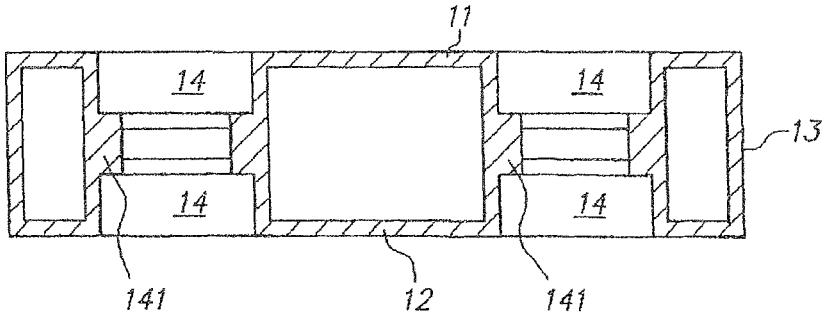
FIG. 6 is a cross-section on line VI-VI of FIG. 5.
Figure 7:
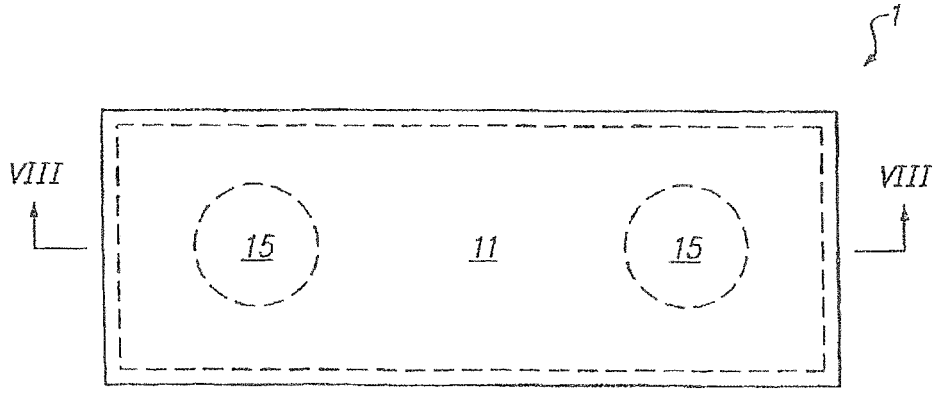
FIG. 7 is a plan view of another embodiment of a horizontal support of the invention.
Figure 8:
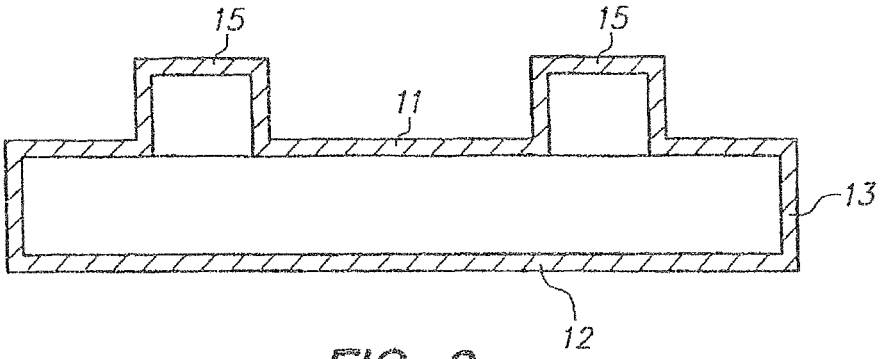
FIG. 8 is a cross-section on line VIII-VIII of FIG. 7.
Figure 9:
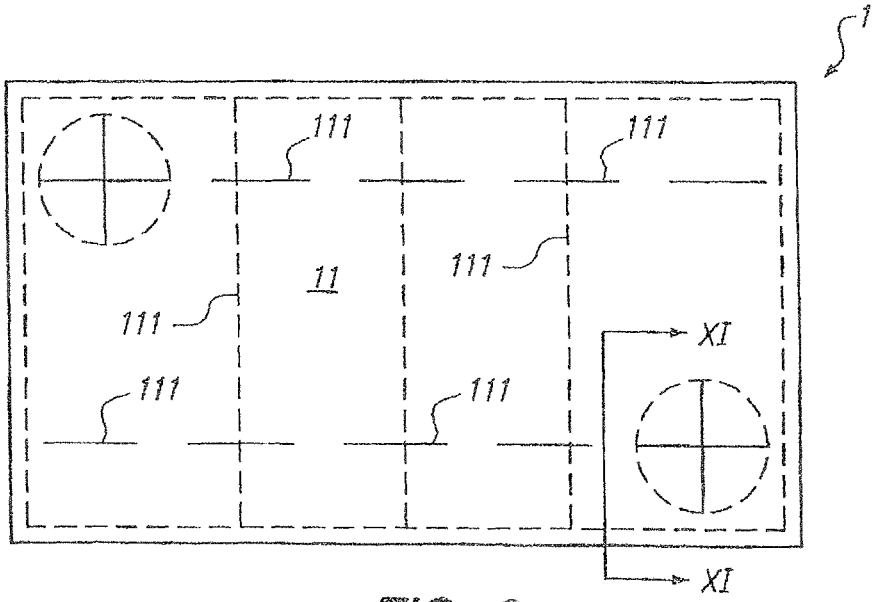
FIG. 9 is a plan view of another, less-preferred, embodiment of a horizontal support.
Figure 10:
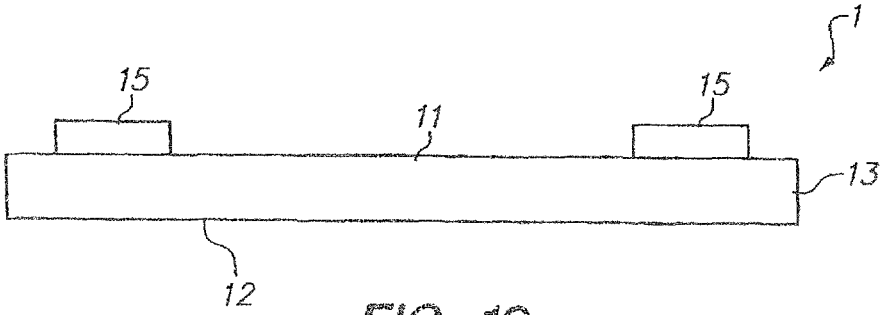
FIG. 10 is a side view of the support of FIG. 9.
Figure 11:
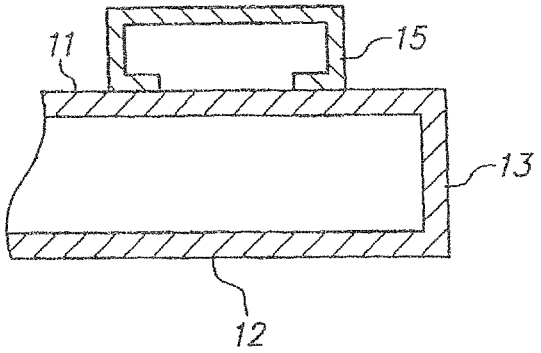
FIG. 11 is a partial cross-sectional view on line XI-XI of FIG. 9.
Figure 12:
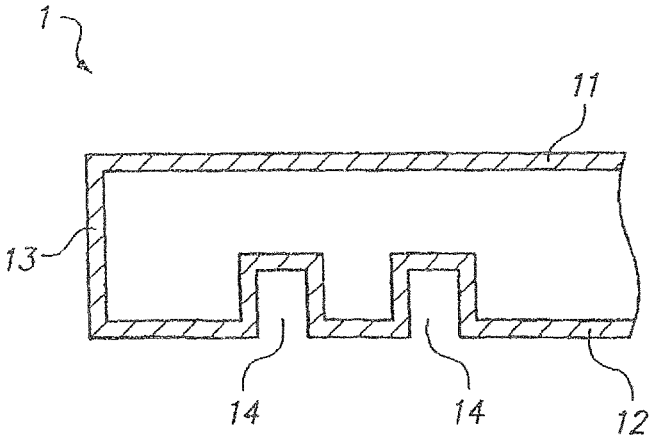
FIG. 12 is a partial cross-section of another embodiment of a horizontal support of the invention.

Referring now to the drawings, FIGS. 1-12 show a horizontal support 1 having an upper member 11, a lower member 12 and a peripheral member 13. In FIGS. 1 and 2, reinforcing ribs 19 extend across the hollow space defined by the upper member, lower member and peripheral member. In FIGS. 1, 2, 3, 4 and 12, two depressions 14 extend 14 upwards from the lower member 12. In FIGS. 1, 2, 3 and 4, the depressions have a circular cross-section. In FIG. 12, the depressions have an annular cross-section. In FIGS. 5 and 6, depressions 14 extend upwards from the lower member and coincidentally from the upper member, and there is a lip 141 which separates the depressions, and which can support a column placed in the depression. In alternative embodiments, other lips, linings, barriers, or other structure may be used to separate the depressions. In FIGS. 7, 8, 9 and 10, projections 15 extend upwards from the upper member 11. In FIG. 9, the upper surface of the upper member 11 carries markings 111 in the form of a grid to facilitate the placing of the projections in a desired location on the upper member. The upper surface of the projections carries markings that can be aligned with the markings 111. The projections 15 can be secured permanently by welding or a permanent adhesive, semi-permanently by an adhesive which can be rendered ineffective by a treatment to which the pedestal will not be subject in use, e.g. a hot melt adhesive which can be rendered ineffective by means of a heat gun, or semi-permanently by some other means, for example by pneumatic forces.

Figure 13:
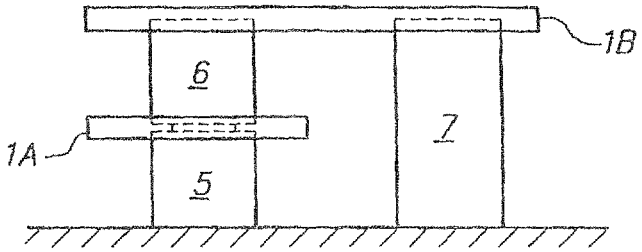
FIG. 13 is a side view and FIG. 14 is a plan view of one embodiment of a pedestal of the invention.
Figure 14:
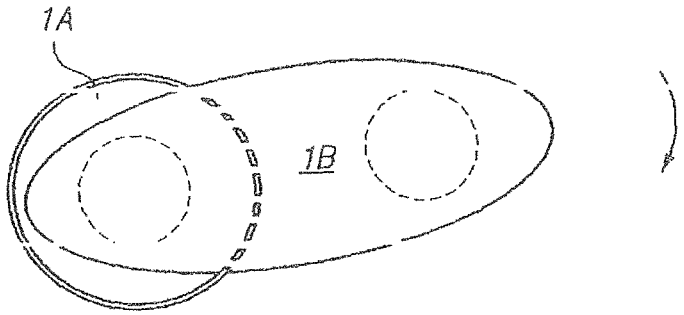

FIGS. 13 and 14 show a pedestal of the invention comprising a circular horizontal support 1A which has a pair of coincident depressions which extend from the upper and lower members respectively and which are separated by a lip as shown in FIG. 6, and a second horizontal support 1B which has an oval shape and which has a pair of spaced apart depressions which extend upwards from the lower member 12 as shown in FIG. 2. A first column 5 is supported on a flat horizontal surface, and its top end is located in the lower depression of the horizontal support 1A. A second column 6 is located in the upper depression of the horizontal support 1A. A third column 7 is placed on the horizontal surface. The tops of the columns 6 and 7 are located in the depressions in the lower surface of the horizontal support 1B. The fittings of the columns to the supports are rotatable, so that the upper horizontal support can be rotated around the columns 5 and 6.

Figure 15:
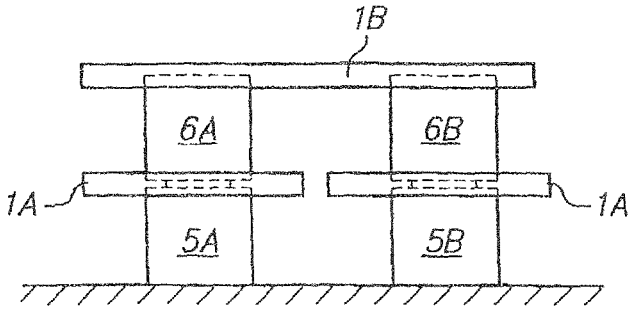
FIG. 15 is a side view of another embodiment of a pedestal of the invention.

FIG. 15 shows a pedestal of the invention which comprises two circular horizontal supports 1A, one of which connects a lower column 5A and an upper column 6A, and the other of which connects a lower column 5B and an upper column 6B. The tops of the column 6A and 6B fit into depressions in the lower surface of horizontal support 1B.

Therefore, certain embodiments may be described as comprising a substantially planar support member which is suitable for use as a horizontal support member in a pedestal and which comprises (1) an upper member which has a substantially continuous planar upper surface, (2) a lower member which has a substantially continuous planar lower surface, and (3) a substantially continuous peripheral member which secures the upper and lower members together, the upper and lower members and the peripheral member defining between them an interior volume which extends over at least part of the area defined by the periphery of the support, and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface. The interior volume may be filled with air, and the support member may have a uniform thickness of 1 to 10 inch, an area, viewed in plan, of 1 to 100 square feet and a volume of at least ½ cubic feet. The support member may have a uniform thickness of 2 to 5 inch, an area, viewed in plan, of 4 to 40 square feet, and a volume of at least ½ cubic feet and less than 8 cubic feet. The support member may have a shape selected from the group consisting of rectangular, rectangular with rounded corners, polygonal, circular, oval and other regularly curved shapes. The upper member of the support member may have a planar upper surface which is free from depressions and projections, and the lower member may have a substantially planar lower surface which comprises one or more depressions or one or more projections. The support member upper member may have a substantially planar upper surface which comprises one or more depressions or one or more projections, and the lower member may have a planar lower surface which is free from depressions and projections. The upper member may have a substantially planar upper surface which comprises one or more depressions, and the lower member may have a substantially planar lower surface which comprises one or more depressions. The support member may have a depression(s) whose periphery is selected from the shapes consisting of circular, annular, polygonal and rectangular with rounded corners. Each of the upper surface and the lower surface may comprise may comprise one or more projections which are permanently secured to the continuous planar surface. Each of the upper surface and the lower surface may comprise a continuous planar surface, and one but not both of the upper surface and the lower surface may comprise one or more projections which are removably secured to the continuous planar surface. Each of the upper and lower members may be composed of a metal in certain embodiments.

Alternatively, certain embodiments may be described as a pedestal which comprises (A) a substantially planar horizontal support member which comprises (1) an upper member which has a substantially continuous planar upper surface, (2) a lower member which has a substantially continuous planar lower surface, and (3) a substantially continuous peripheral member which secures the upper and lower members together, the upper and lower members and the peripheral member defining between them an interior volume which extends over at least part of the area defined by the periphery of the support, and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface; and. (B) a vertical column which fits into a depression in the horizontal support or which fits over a projection extending from the horizontal support. The support member may have a uniform thickness of 2 to 5 inch, an area, viewed in plan, of 4 to 40 square feet, and a volume of at least ½ cubic feet and less than 8 cubic feet; and a shape selected from the group consisting of rectangular, rectangular with rounded corners, polygonal, circular, oval and other regularly curved shape shapes. Each of the upper and lower members may be composed of a material selected from metal, aluminum, composite, wood, cardboard, paper, polymer, recycled or new materials, other materials, or combinations of these materials.

Such pedestals may comprise first and second vertical columns each of which is fitted to a said horizontal support member. Such pedestals may comprise a hollow tube which fits rotatably to a depression or a projection on the top surface of the horizontal support member and which comprises at least two pairs of open channels into which horizontal support members, such as longer-than-wide and longer-than-thick rods for example, can be fitted. A first column may have a first axis and may fit rotatably into a recess or over a projection on the lower surface of the support member, and a second column may have a second axis and may fit rotatably into a recess or over a projection of the upper surface of the support member, the first vertical axis lying within the periphery of the second column. Certain pedestals may have a first lower vertical column may have a top and a bottom and a first lower vertical axis, (2) a first upper vertical column may have a top and a bottom and a first upper vertical axis which is coincident with the first lower vertical axis, (3) a second vertical column having a top and bottom; (4) a first said intermediate horizontal support member, the top of the first lower vertical column being fitted to a recess or projection in the lower surface of the first horizontal support member and the bottom of the first upper vertical being fitted to a recess or projection in the upper surface of the first horizontal support member, and (5) a second set upper horizontal support member, the top of the first upper vertical column being fitted to a recess or projection in the lower surface of the second horizontal support member and the top of the second vertical column being fitted to a recess of projection in the lower surface of the second horizontal support member. In such pedestals, all the connections between the columns and the horizontal support members may be rotatable.

Especially-Preferred Embodiments, and FIGS. 16-41

In especially-preferred embodiments, multiple elongated top support members and multiple elongated intermediate support members are used, and multiple or all of each support member type are rotatable relative to each other. The preferred support members are elliptical in shape, but other embodiments may include other shapes, with the shapes preferably being much longer than wide and much longer than thick. Preferably, the support members each have an upper surface that is elliptical, a lower surface that is elliptical, parallel to or generally parallel to, and of the same length and width and perimeter shape as the upper surface, and a side edge that extends around the support member to connect said upper surface and said lower surface.

The support members are supported and held at desired levels above the ground, floor, table, stage, or other "platform" by vertical pillars. The vertical pillars comprise, and preferably consist essentially of, or consist of, one or more columns, and, in the case of multiple columns, one or more portions of intermediate support members. Typically, the ends of the intermediate support members are the portions between the columns of the vertical pillar, and the columns support, position, and lift the support members above the platform and relative to the surrounding/adjacent other support members.

Preferably, the support members are rotatable relative to each other by being rotatable relative to the columns above and below, including between the support members, or, alternatively and less preferably, by fixed-column units being rotatable relative to the unit(s) above and/or below them. Due to the modularity, elongation, and rotation of the preferred modular support members and the preferred columns of the pillars supporting the support members, pedestals may be built from a given number of given components, and transformed into many, very different configurations and uses, by rotating the support members and/or columns into different positions, and also by switching support members and/or columns into different locations within the pedestal. Use of said multiple intermediate support members and multiple top support members, preferably rotatable on multiple vertical pillars, can provide pedestals that, overall, are complex, long, and/or wide; have many turns, curves, branches, and/or layers; and/or that fit a space or event, for example, a particular room, business, residence, corridor, corner, table set-up, banquet size, and/or amount of merchandize or other display items.

The support members in certain embodiments may be called "plates" or "panels" or "horizontal display members" or "generally horizontal display members", as their structure and main function is to provide horizontal or generally horizontal upper surface area that is sized, position, and/or exposed to an extent that display items may be placed on them for the intended display, catering, serving, marketing, decorating, or other purpose of the pedestal. The support members may be made of various materials, such as metal, aluminum, composite, wood, cardboard, polymer, recycled or new materials, other materials, or combinations of these materials, and, as discussed elsewhere in this document, they may be solid, partially hollow, or hollow.

In the especially-preferred embodiments, pedestals comprise a lowermost layer of support members and columns, preferably built of multiple lowermost intermediate support members each having a first and second end (opposite ends) resting on respective first and second columns, which in turn rest directly on a single, larger, horizontal surface such as the ground, floor, table, stage, or other platform. Resting on each lowermost intermediate support member preferably may be one or two additional columns that support ends of different, additional support members, with the opposite ends of the different, additional support members being supported by other columns extending to other intermediate support members or even all the way to said floor, table, stage, or other platform. Likewise, additional columns may rest on said different, additional support members, to support different, yet further support members. This way, in some areas of the pedestal, some of the support members at their two opposite ends connect, via cooperating columns, multiple other support members, resulting in a region (or "formation" or "portion") with a "stair-step" configuration. Because some or preferably all of the connections between columns and support members are rotatable, the stair-step configuration can result a pedestal build-up of many different heights and shapes and with a large amount of upper surface area for display.

In other areas of the pedestal, certain of the intermediate support members may have another support member (another intermediate, or a top, support member) directly above it and aligned so that the perimeters of the support members are exactly aligned or generally aligned. The columns at the first end of the two support members are preferably coaxial or generally coaxial, and the columns at the other, second end of the two support members are preferably coaxial or generally coaxial. In other embodiments, however, the columns may be offset and therefore not coaxial, but the support members are still exactly or generally aligned at their outer perimeters. Such arrangements form a "shelf-style" region (or "formation" or "portion") of the pedestal and may be mixed with the "stair-step" region(s) of the pedestal. "Shelf-style" regions of a pedestal may limit access to the lower of the two "shelves" of the shelf-style region, or limit the height of items to be displayed on the lower "shelf". Such regions may be desirable for aesthetic or other reasons, however, such as holding many similar items that do not need to be spread out or individually and prominently displayed.

Figure 16:
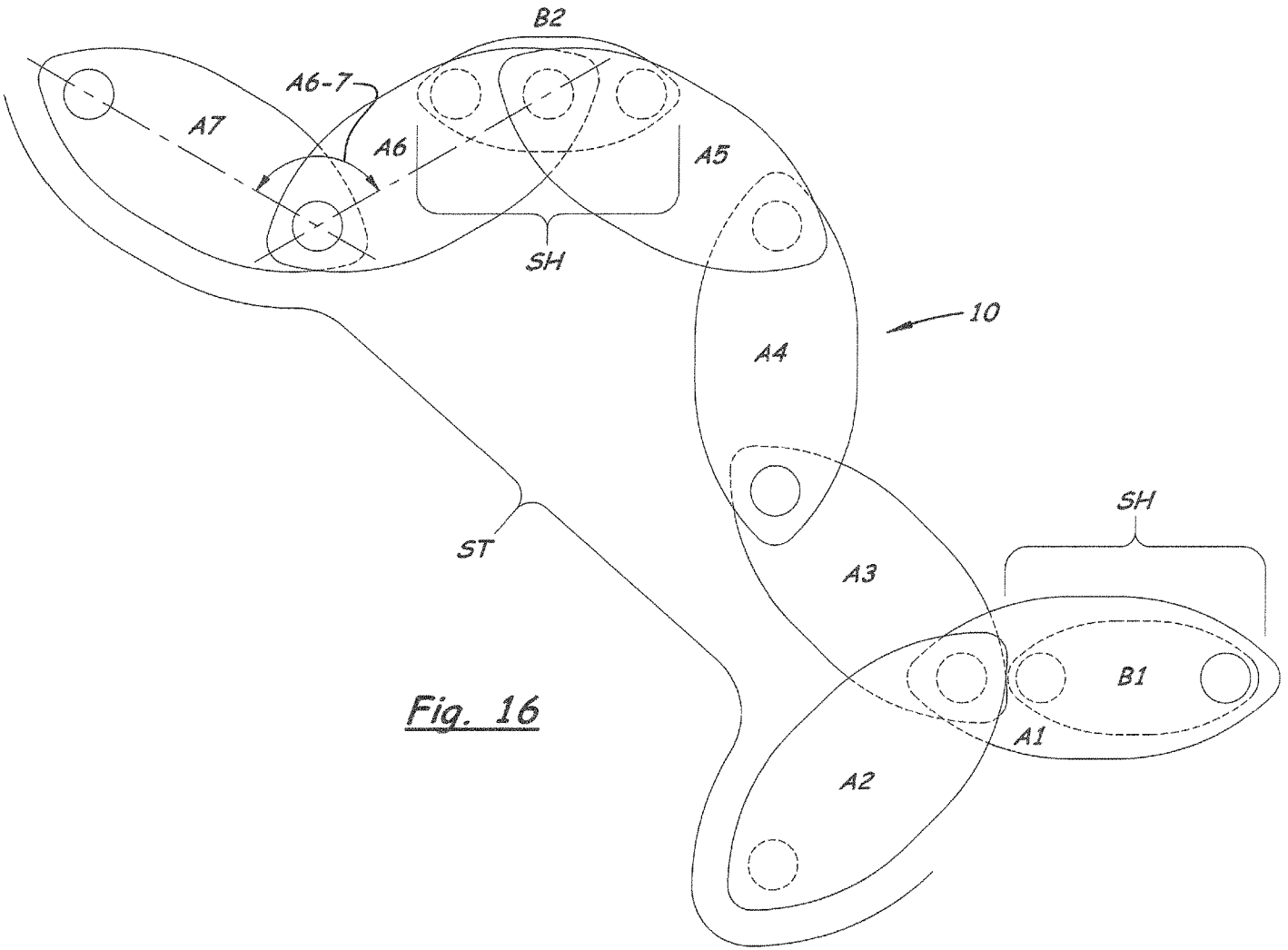
FIG. 16 is a top view of an especially-preferred, branched pedestal, built from multiple, elongated intermediate support members and multiple, elongated top support members, with cooperating columns.
Figure 17:
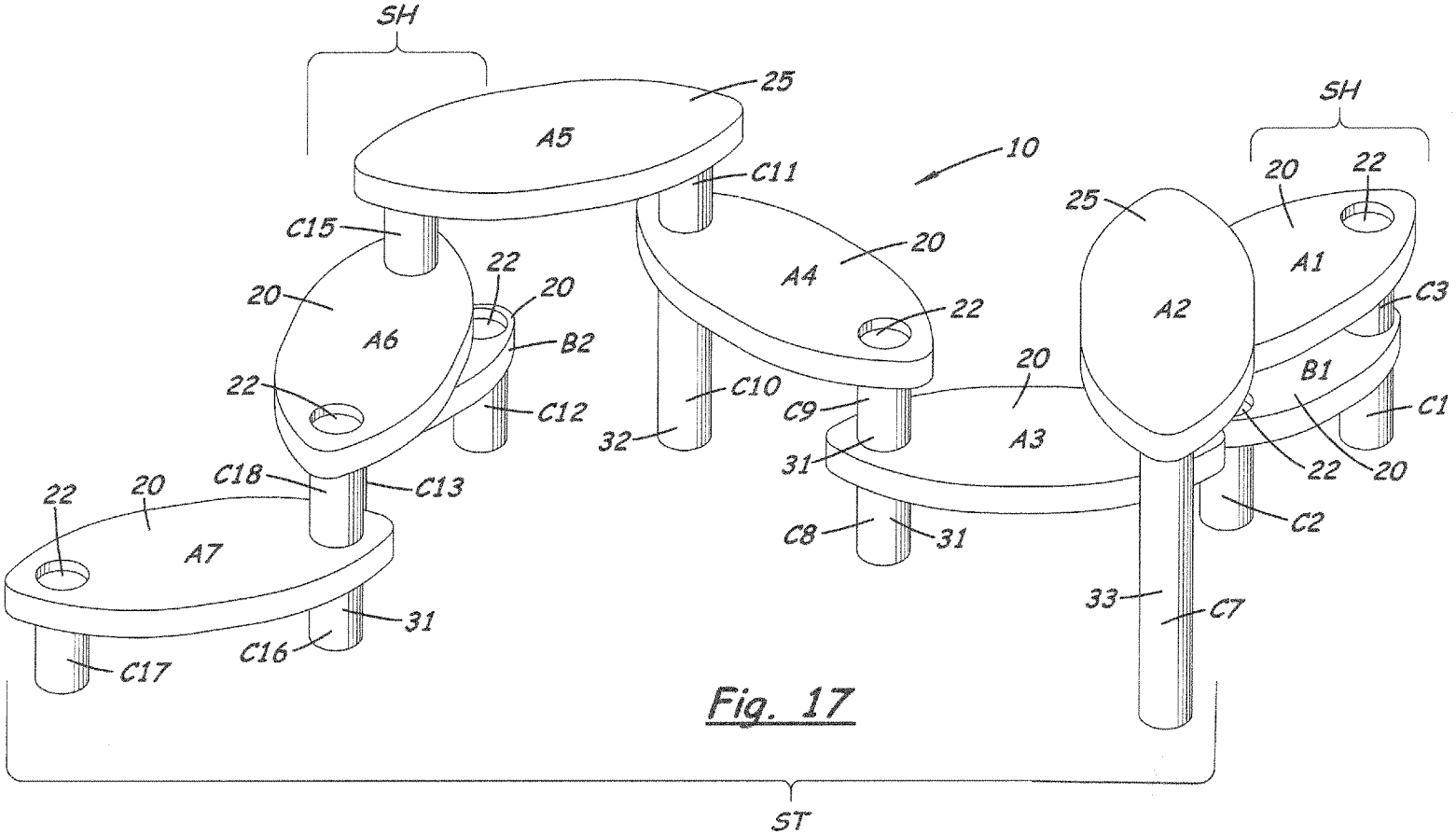
FIG. 17 is a front perspective view of the pedestal of FIG. 16.
Figure 18:
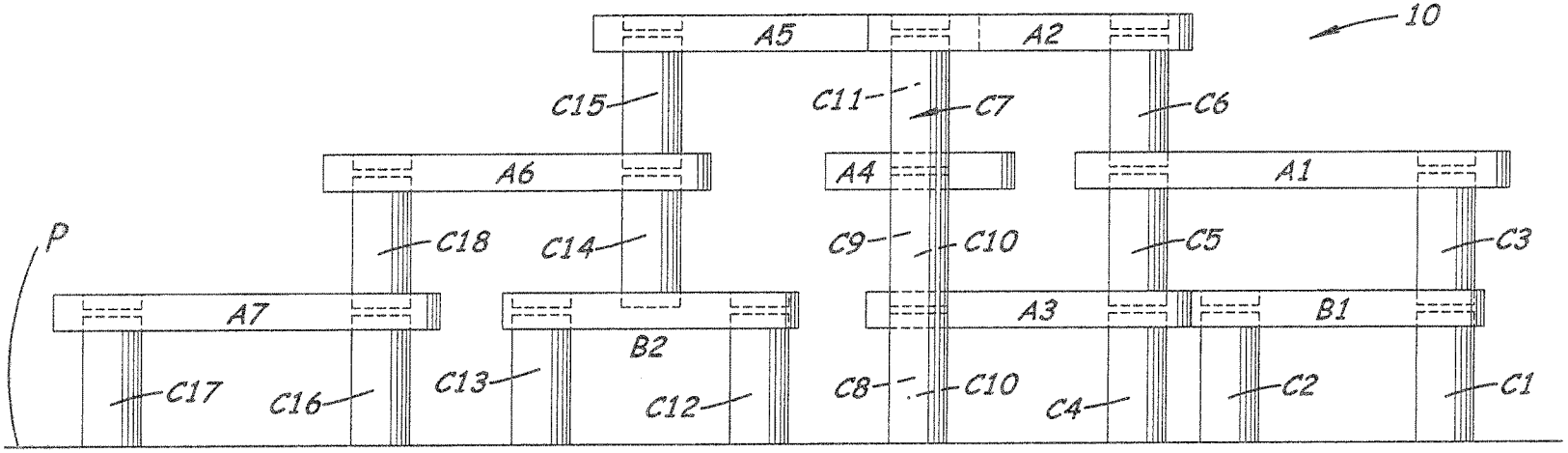
FIG. 18 is a front view of the pedestal of FIGS. 16 and 17.

Referring to the pedestal 10 of FIGS. 16, 17, and 18, the pedestal 10 is built from nine support members of two sizes, namely a larger support member size (A1-A7) and a smaller support member size (B1 and B2). The nine support members include seven intermediate support members 20 and two top support members 25. Each support member is preferably an ellipse in top view, and preferably has an elliptical top surface and an elliptical bottom surface of the same shape and dimensions. Most of the support members are used as intermediate members 20 as they have column(s)

below them and column(s) above them, and two of the support members are used as top support members 25 that are uppermost members in a region of the pedestal and hence have no columns or support members above them. See call-out numbers 20, 25 in FIG. 17.

The intermediate support members 20 have one or more recesses (also called herein "depressions") in their upper surfaces for receiving columns, while the top support members 25 preferably do not have recesses in their upper surfaces for receiving columns. The intermediate support members 20 (A1, A4, A6, and A7) that have only one column above them at one end are drawn as having an exposed recess 22 at the opposite end. The B2 intermediate support member 20 has three recesses including one in the center of the member 20 that receives column C14 (see FIG. 18), and two exposed recesses 22, at each end of B2. Some or all of the exposed recesses 22 could be optionally eliminated, covered, or plugged, to make the exposed end continuously planar/smoother and/or more aesthetic, or optionally could be used to receive a column of another stack of components to expand the overall size and length/width of the pedestal.

Eighteen columns are provided in multiple vertical pillars to support and rotatably connect the support members 20, 25. Based on how and where the ends of each support member 20, 25 extend, columns of three lengths are used, including single-length columns 31, double-length columns 32 that span about the height of two single-length columns and one support member, and triple-length columns 33 that span about the height of three single-length columns and two support members. In FIG. 17, rather than numbering each column according to length, three examples of single-length columns 31 are called out, with the understanding that all of C1-C3, C4-C6 (each hidden behind A2 and C7 in FIG. 17), C8, C9, C11, C12, C13, C14 (hidden in behind A6 in FIG. 17), C15, and C16-18 are each single-length columns 31. Column C10 is a double-length column, and column C7 is a triple-length column 33. Note that, in FIG. 18, column C7 is in front of, and hides, all of columns C8, C9, C10 and C11 due to the direction of viewing in the front view.

It may be seen in FIGS. 16, 17 and 18 that the columns in each of the multiple-column pillars of pedestal 10, with the exception of the columns C12, C13, and C14 engaging/cooperating with support member B2, are coaxial. In other words, columns C1 and C3 are coaxial, columns C4, C5 and C6 are coaxial, columns C8 and C9 are coaxial, Columns C10 and C11 are coaxial, and columns C16 and C18 are coaxial. Columns C12 and C14 may be considered offset (non-coaxial), or columns C13 and C14 may be considered offset (non-coaxial), while columns C14 and C15 may be considered coaxial.

Figure 17A:
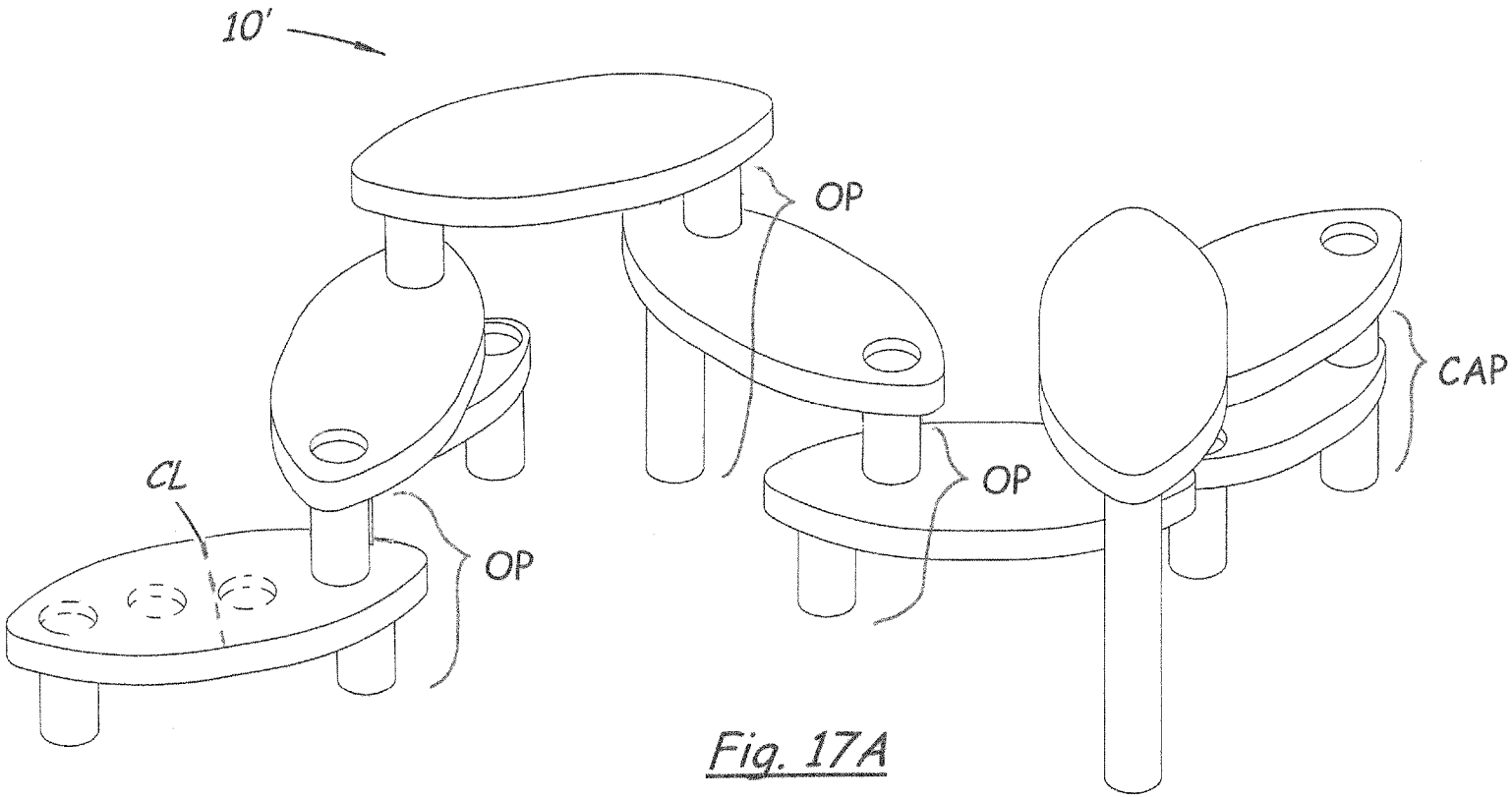
FIG. 17A is a front perspective view of a pedestal similar to that of FIGS. 16 and 17, wherein some of the pillars are adapted to be offset-axes pillars, wherein columns are not coaxial.

FIG. 17A illustrates how the pedestal shown in FIGS. 16, 17 and 18 may be adapted, with alternative recesses (or "depressions") in the surfaces of support members, to provide offset columns in the pillars supporting the support members. By providing such differently-located recesses, columns may engage the support members in ways that form "offset columns" or "offset pillars". See the offset pillars OP compared to the coaxial pillars CAP, in pedestal 10' of FIG. 17A. Multiple recesses are shown in solid and dashed lines on the top of the farthest-left support member, to emphasize that engagement, including rotatable and/or detachable engagement, of the columns with support members may be provided at various location on the upper surfaces of support members. Said engagement, including and/or detachable engagement, of columns with support members may also be provided at various locations on the lower surfaces of support members, as will be understood from this disclosure. Note that one of the recesses shown in dashed lines is at or near centerline CL.

It may be seen to best advantage in FIG. 16, that pedestal 10 is arranged in a branched and curved configuration in FIGS. 16-18. Three support members A1, A2 and A3 each have one end that is rotatably connected to columns that are all coaxial, forming two branches (A1 and A2) off of the main spine (A3-A7) of the pedestal. The main spine (A3-A7) curves/bends in multiple locations, with the length of none of the support members A3-A7 being parallel to the others, and none of the support members A3-A7 extending in a straight line. In the configuration of FIGS. 16-18, the smaller support members B1 and B2 are underneath one or two higher support members, respectively, but it will understood that B1 and B2 could be rotated to other positions that would be partially exposed and optionally connected to other components by receiving a column of another stack.

Different regions of pedestal 10 are built up to different heights, due to differing numbers of layers of support members and columns, or, in other words, due to vertical pillars of different lengths. Pedestal 10 may be described as having three support-plus-column layers in the regions of its maximum height. Columns C1, C2, C4, C8, C12, C13, C16 and C17 supporting support members B1, A3, B2, and A7 form a lowermost or first layer, that rests on platform P (FIG. 18). Columns C3, C5, C9, C14, and C18, and supporting support members A1, A4, and A6 form a middle or second layer. Columns C6, C11, and C15, and triple-length column C7 supporting support members A2 and A5 form the third or third layer. Note that many of the support members rest on columns that rest on two different, separate support members. Also, note that top support member A2 may be described as being supported by two vertical pillars, with each of intermediate support members A1 and A3 being supported (at an inner end) by one of the vertical pillars supporting said top support member A2 but extending to and being supported (at an outer end) by another pillar that is not supporting top support member A2. Also, note that top support member A5 may be described as being supported by two vertical pillars, with each of intermediate support members A4 and A6 being supported (at an inner end) by one of the vertical pillars supporting said top support member A5 but extending to and being supported (at an outer end) by another pillar that is not supporting top support member A5. Further, note that some of the support members rest on columns of different lengths. For example, A2 rests on a single-length column C6 at one end and on a triple-length column C7 at the other, opposite end, and A4 rests on a single-length column C9 at one end and on a double-length column C10 at the other, opposite end.

Pedestal 10 may be described as comprising mainly "stair-step" formations/regions ST, with substantial amounts of the upper surface area of the support members, besides B1 and B2, being exposed for display. Only B1 and B2 are located substantially or entirely underneath other support members (A1 for B1, and A5 and A6 for B2) so that their upper surfaces are not as accessible except for smaller display items. Therefore, B1 and B2 may qualify generally as forming small "shelf-style" formations/regions SH of the pedestals. Still, as B1 and B2 are each only connected to other support members by a single column, B1 and B2 optionally may be rotated relative to said single column to expose more of their upper surfaces, as illustrated in FIGS. 19 and 20.

A plurality, or all, of the column-to-support member connections of pedestal 10 are preferably detachable and rotatable. For example, the column top and bottom ends may vertically slide into, and rotatably rest in, recesses/depressions in the bottom surface of the support member above, and in the top surface of the support member below, respectively. A cylindrical or otherwise-shaped top end and bottom end may slide into and rotate in a cylindrical recess, for example. The preferred fit of the column ends to their respective recesses may be close, or even snug but fairly easily manually-rotatable. The preferred rotatability is 360 degrees, but in certain embodiments may be less, for example, at least 270 degrees, at least 225 degrees, at least 180 degrees, or at least 90 degrees. For example, rotatability in the range of 180-360 degrees, or more preferably 225 to 360 degrees, allows the support member to be rotated (also, "swung" or "pivoted"), typically only in a horizontal plane, to an extent that can substantially change a pedestal configuration without changing out (switching) to other components.

Several of the support members of pedestal 10 are at angles to each other in the range of 110-130 degrees, wherein the angle is measured between the longitudinal axes of the support members. For example, in FIG. 16, see the 110-130 degree angle A6-7, and also the similar angles between members A5 and A6, A4 and A5, and A3 and A4. The angles between A1 and A2 and A1 and A3 are each in the range of 130-140 degrees, and the angle between A2 and A3 is in the range of 85-95 degrees. The angle between B2 and A1 may be considered to be zero degrees.

Figure 16A:
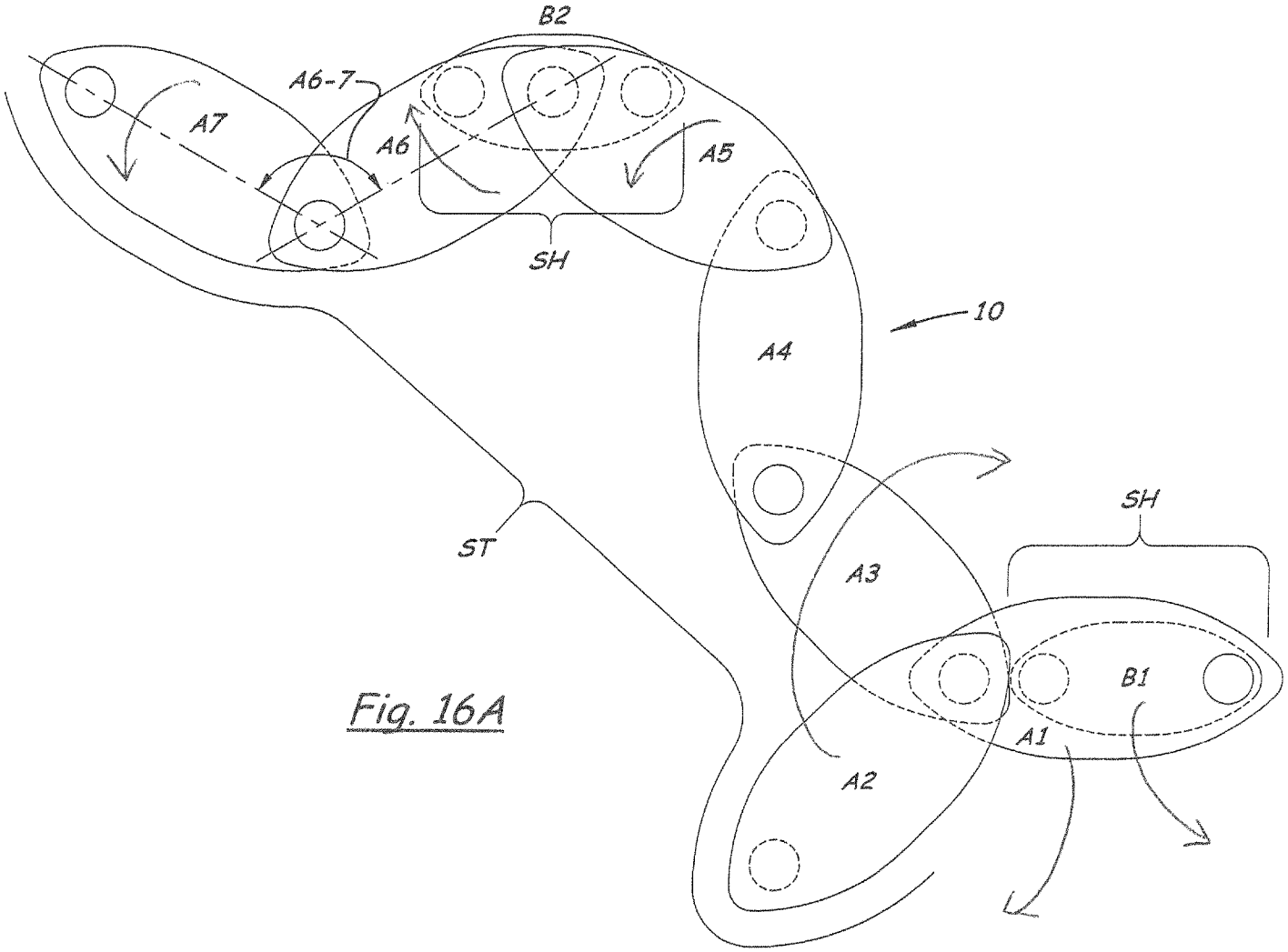
FIG. 16A is a top view of the pedestal of FIG. 16 with arrows showing how it may be transformed into the pedestal of FIGS. 19 and 20.
Figure 19:
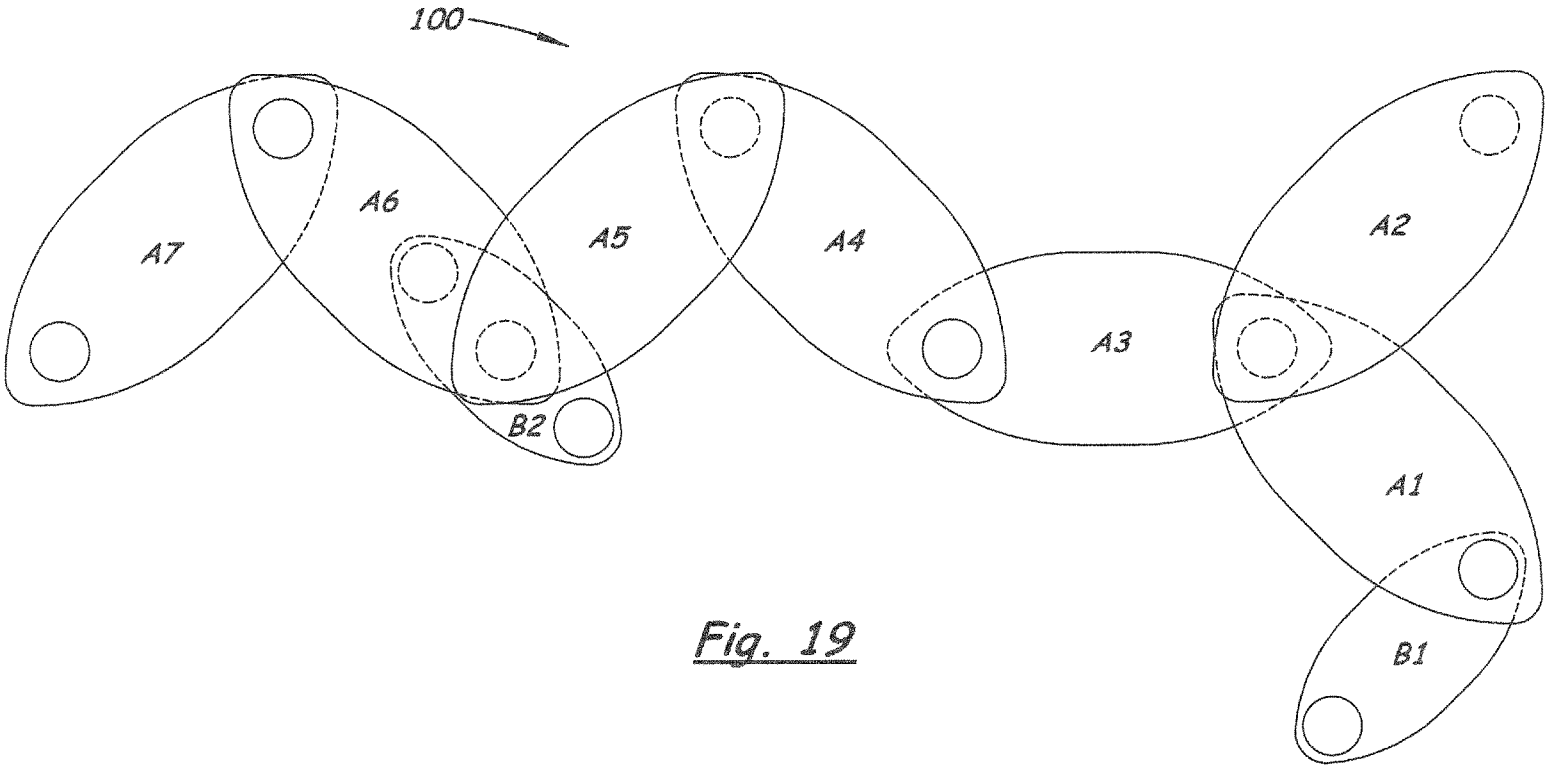
FIG. 19 is a top view of the same pedestal components as in the pedestal of FIGS. 16, 16A, and 17, rotated into an alternative pedestal configuration and appearance.
Figure 20:
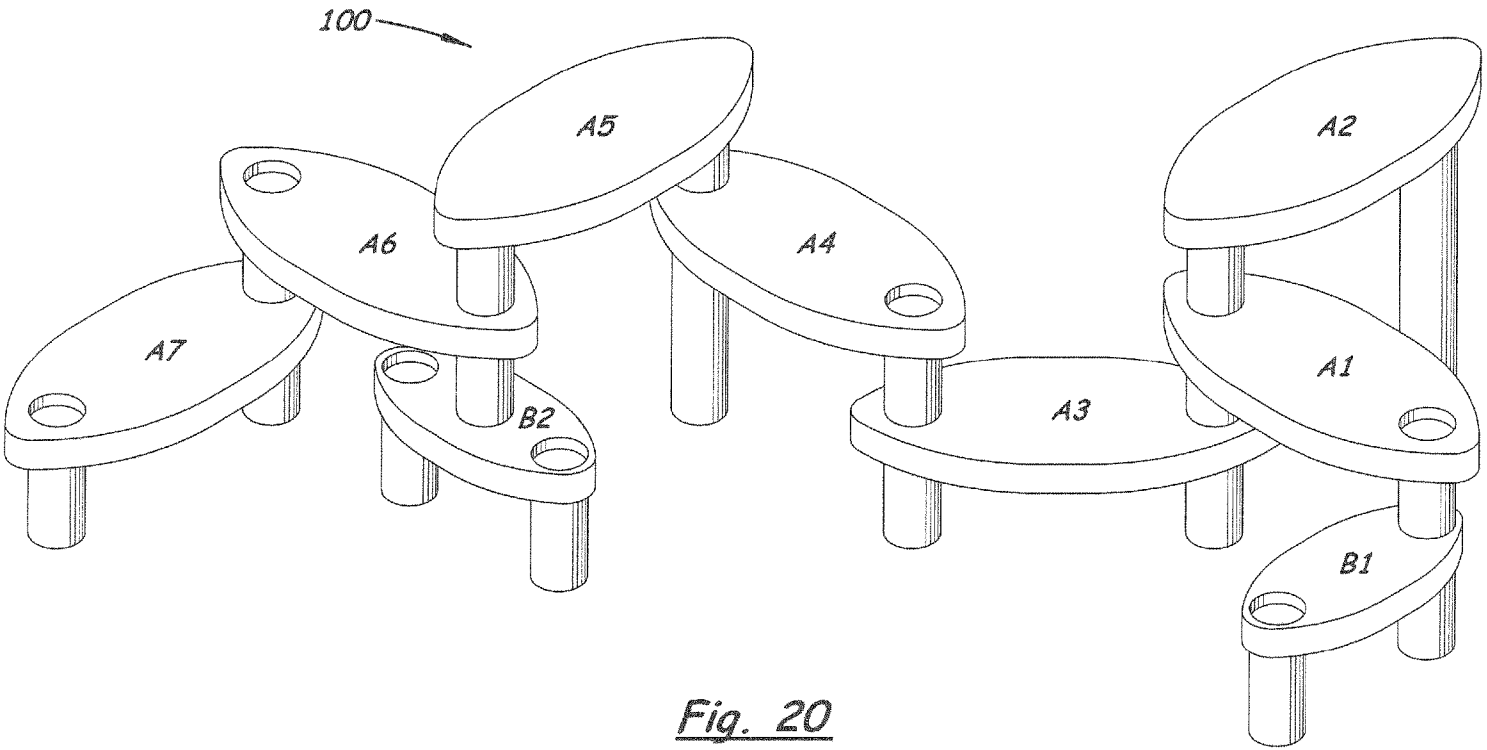
FIG. 20 is a front perspective view of the pedestal configuration of FIG. 19.

In FIGS. 19 and 20, the same components as in pedestal 10 of FIGS. 16-18 are used. Many of the components are rotated/swung relative to each other to a different configuration to create pedestal 100, which has a different appearance, different footprint on the horizontal platform, and may have a different use, compared to pedestal 10. Arrows are drawn in FIG. 16A to show the directions of rotation of the components of pedestal 10, in order to achieve the configuration of pedestal 100. The components (support members and columns) of pedestal 100 are not detached and moved to different regions compared to their general positions in pedestal 10, but are only rotated (swung, pivoted) relative to each other in horizontal planes. Alternatively, one may understand from this disclosure how the components, due to their modularity, could be detached, preferably by lifting/lowering them vertically relative to each other, or by otherwise detaching them from each other, and moved to contact and cooperate with different of the components, and/or some components could be removed, and/or additional components could be added.

In pedestal 100, the angle between A3 and A4 is maintained to be the same or about the same as in pedestal 10, and all of A1, A2, A5, A6, A7, B1, and B2 have been rotated at their rotatable connections to columns to substantially change the configuration. In pedestal 100, A1 and A2 are now each 130-140 degrees from A3, and A1 is 85-95 from A2. The angles between A4 and A5, A5 and A6, and A6 and A7 are now 85-95 degrees, or about 90 degrees. B1 and B2 have been rotated to expose more of their upper surfaces; the region of B2 may now be called a "stair-step" style region rather than a "shelf" style region. Pedestal 100 is another example of a "branched" pedestal, or a "zig-zag" style wherein the pedestal bends back and forth away from and toward the viewer at the bottom of FIG. 19.

Figure 21:
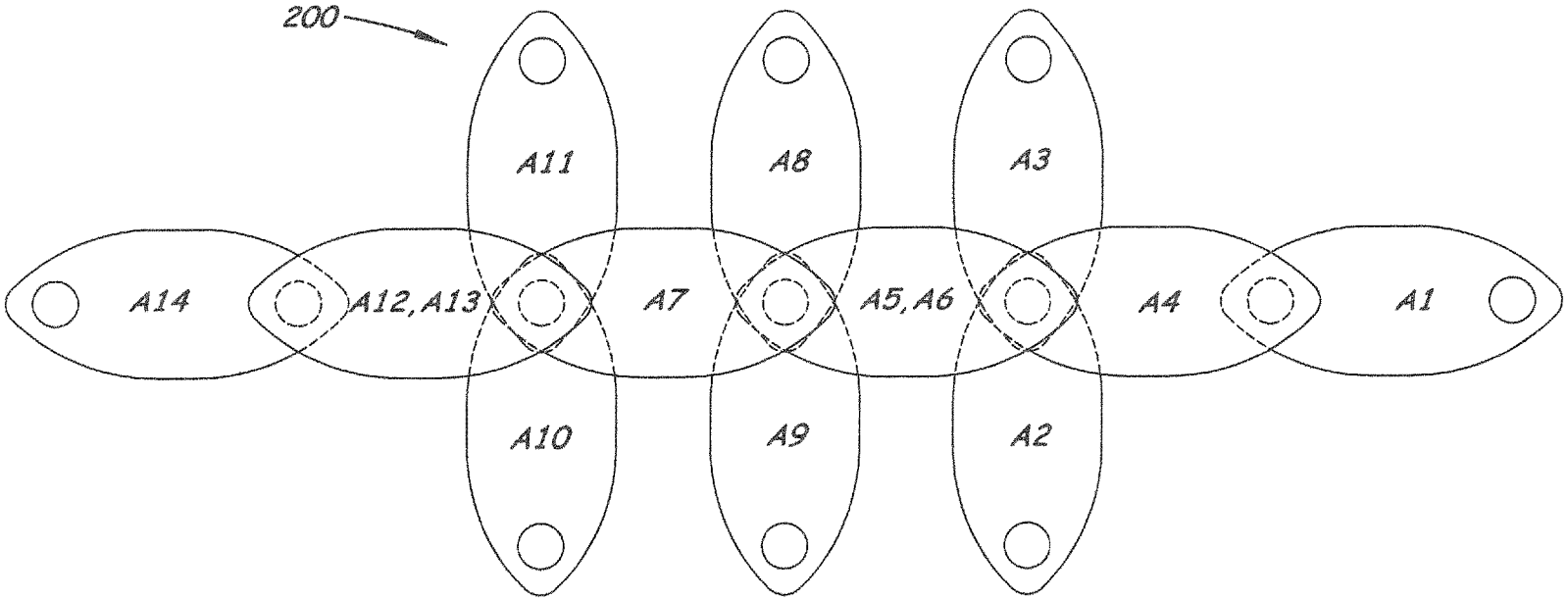
FIG. 21 is a top view of an alternative, especially-preferred, branched pedestal, built from multiple, elongated intermediate support members and multiple, elongated top support members, with cooperating columns.
Figure 22:
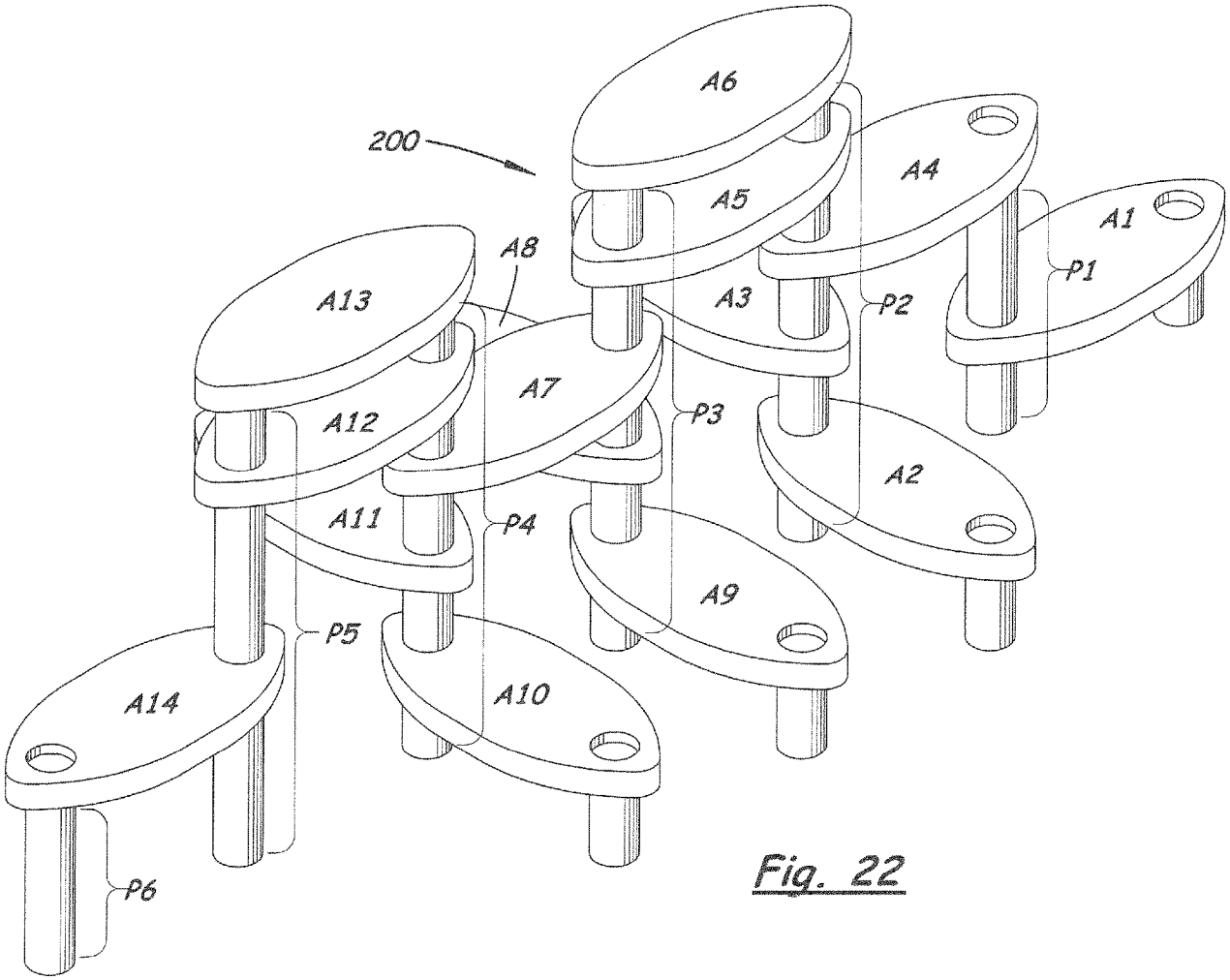
FIG. 22 is front perspective view of the pedestal of FIG. 21.

FIGS. 21 and 22 portray a pedestal 200 composed of a different set of components compared to pedestals 10 and 100. The support members A1-A14 are all the larger size, with A6 and A13 being top support members without upper surface recesses/depressions, and the other support members being intermediate support members having two columns below and at least one column above said intermediate support members. In the lowermost, first layer, support members A1, A2, A9, and A10 rest on single-length columns, and A14 rests on two double-length columns, all of which columns rest on the floor/table/stage or other generally horizontal platform. Support members A3, A8, and A11 may be considered a second layer of the pedestal 200, because they each have an end resting on one column that rests on one of the first layer support members, while the opposite ends rest on double-length columns that extend down to rest on said platform. A7 and A4 may be considered a third layer, as they each have at least one end resting on a column that rests on the second layer, but A4 has an opposite end that rests on column resting on a first layer support member. A5 and A12 may be considered a fourth layer, resting on at least one column that rests on the third layer, and wherein A12 has one end resting on a column resting on the third layer and an opposite end resting on a column that rests on the first layer by means of a double-length column reaching to the "tall support-member" A14. The top support members A6 and A13 may be described as a fifth layer, aligned and directly above A5 and A12, respectively. The two sets of A5 and A6, and A12 and A13, each form a "shelf" region SH of the otherwise "stair-step" style pedestal 200. Note that, because A6 and A13 each have both their depending columns resting on the same support member (A5 and A12, respectively), neither of A6 or A13 will rotate relative to the respective support member directly below, without lifting up the support member A6 and A13 and moving it to another place in the configuration. Labeled as P1-P5, column and portions of support members that are generally aligned vertically to form "vertical pillars" are discussed later in this document. As also discussed later in this document, a single column such as P6 may also be called a "vertical pillar".

Pedestal 200 may be described as a straight pedestal "spine" with perpendicular branches extending from it. Thus, A1, A4, A6, A7, A13, and A14, in top view are all on a straight line (with A5 and A12 directly below also in the straight line), and the sets of A2 and A3, A9 and A8, A10 and A11 lie each in a straight line transverse to, and spaced apart on, the "spine". Note that this embodiment has multiple intermediate support members (for example, A4, A7, A14) that each has one end (an "inner end") supported by one pillar that also supports a given top support member, and that each extends away to be supported (typically at or near "an outer end") by another, different pillar not supporting said given top support member. Further, however, this embodiments has multiple intermediate support members (A5 and A12) that each extends between and is supported by the two pillars supporting the its respective top support member.

Figure 23:
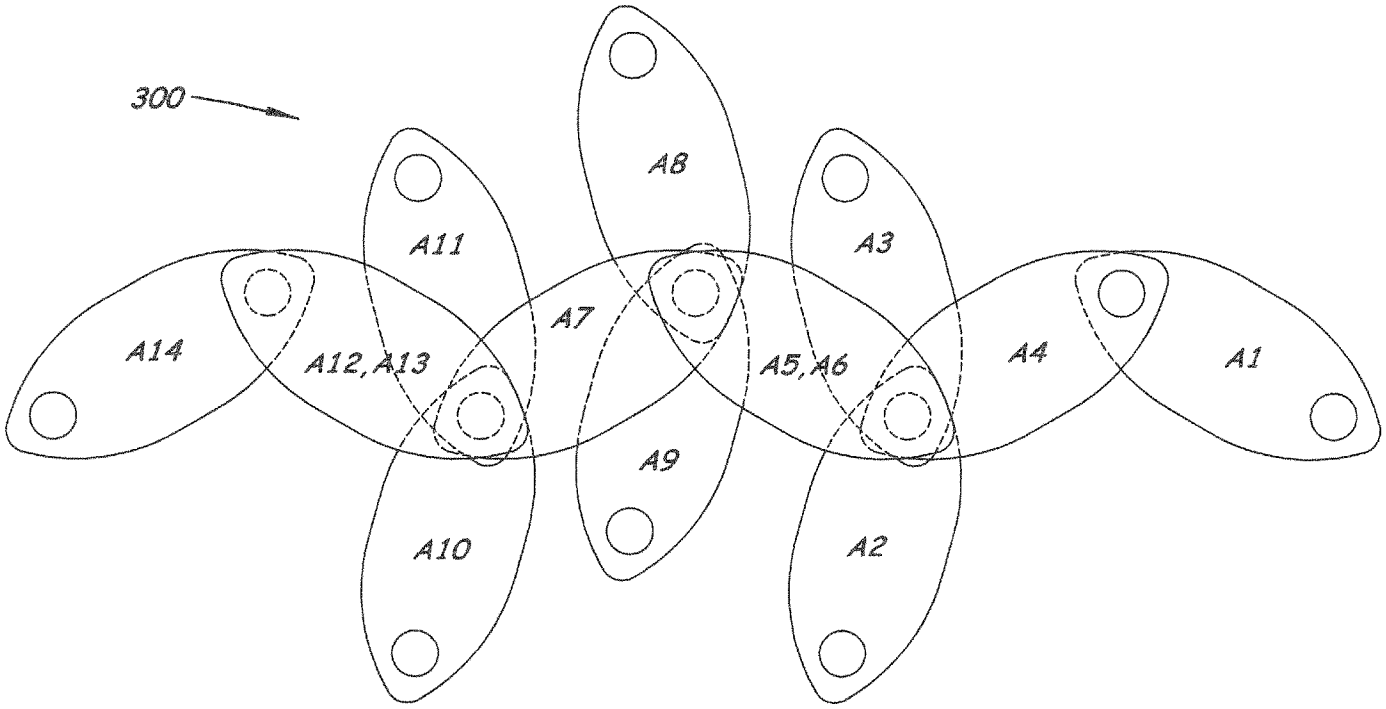
FIG. 23 is a top view of the same pedestal components as in the pedestal of FIGS. 21 and 22, rotated into an alternative pedestal configuration and appearance.
Figure 24:
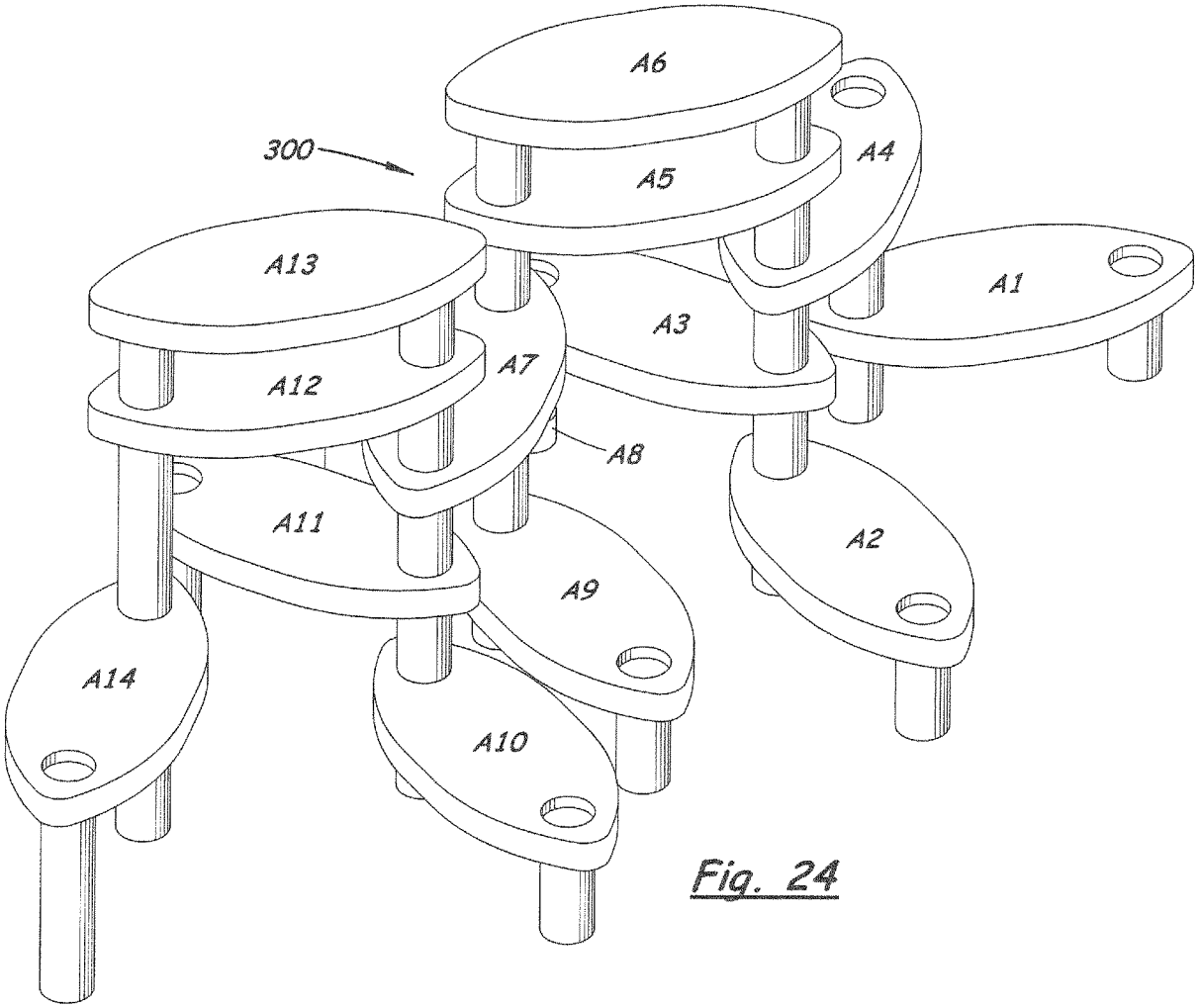
FIG. 24 is a front perspective view of the pedestal configuration of FIG. 23.
Figure 25:
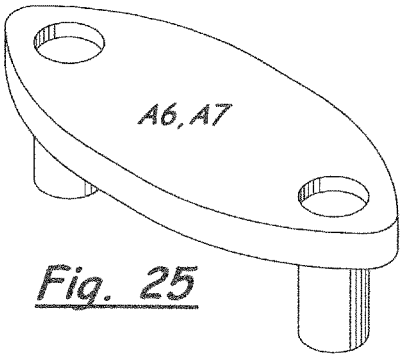
FIGS. 25-30 are front perspective views of pedestal components used in the pedestals of FIGS. 16-24.
Figure 26:
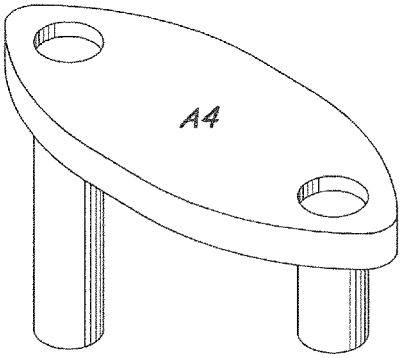
Figure 27:
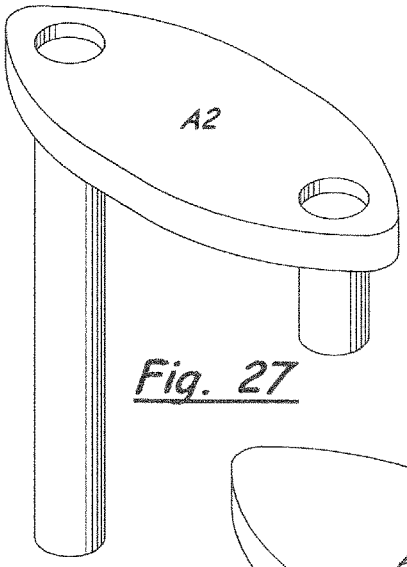

In FIGS. 23 and 24, the same components as in pedestal 200 are used. Many of the components are rotated relative to each other to a different configuration to create pedestal 300, which has a different appearance, different footprint on a floor/table/stage or other platform, and may have a different use, compared to pedestal 200. The components of pedestal 200 are not detached and moved to different regions compared to their general positions in pedestal 100, but are only rotated relative to each other in horizontal planes. Alternatively, one may see how the components, due to their modularity, could be lifted/lowered vertically, or otherwise detached, and moved to contact and cooperate with different of the components, and/or some components could be removed, and/or additional components could be added.

In FIGS. 23 and 24, one may see that the "spine" of pedestal 200 is now a "zig-zag" formation, extending away and toward a viewer at the bottom of the sheet of FIG. 23. The transverse branches are still present, but are now in the range of 150-170 degrees to each other, rather than 180 degrees to each other. The sets of support members A5 and A6, and A12 and A13, are still vertically aligned, and so still form shelf regions of the pedestal 300, while the other regions of the pedestal 300 are maintained as stair-step regions.

Figure 28:
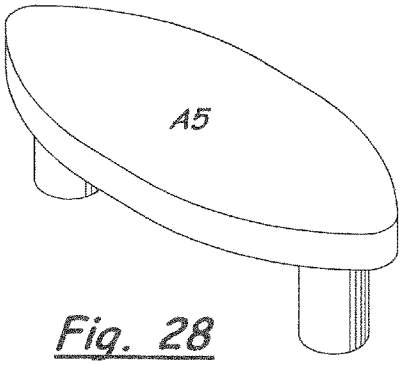
Figure 29:
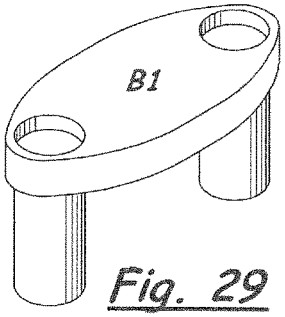
Figure 30:
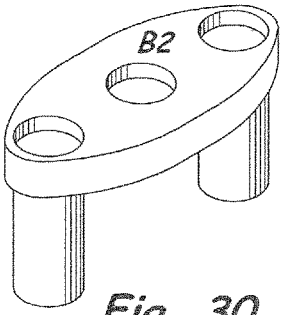

Examples of the components used in pedestals 10 and 100 and/or 200 and 300 are shown in FIGS. 25-30. FIGS. 25-27, 29 and 30 include support members A6, A7, A4, A2, B1 and B2 that have recesses/depressions for receiving columns on their upper surfaces, and so are typically used as intermediate members. FIG. 28 shows support member A5 that has no recess for receiving any columns on its upper surface, and so typically is used as a top support member.

Figure 31:
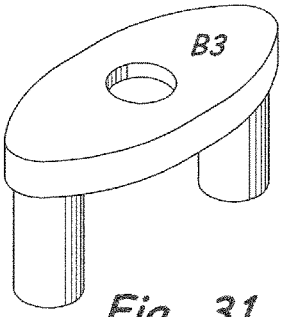
FIGS. 31 and 32 are front perspective views of alternative pedestal components that may be used in alternative pedestals.
Figure 32:
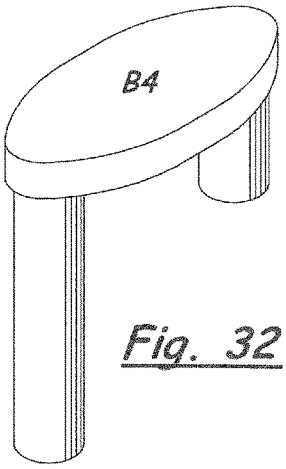

FIGS. 31 and 32 show alternative components that are not included in pedestals 10, 100 200, or 300 but which could be incorporated into, or substituted for other components of, these pedestals. For example, B3 could be used instead of B2, as only one column engages the upper surface of B2. For example, B4 could be installed to have its single-length column rest in the exposed recess of B1 in pedestal 100 (FIGS. 19 and 20), with its double-length column resting on the platform, to increase display area of pedestal 100.

Figure 33:
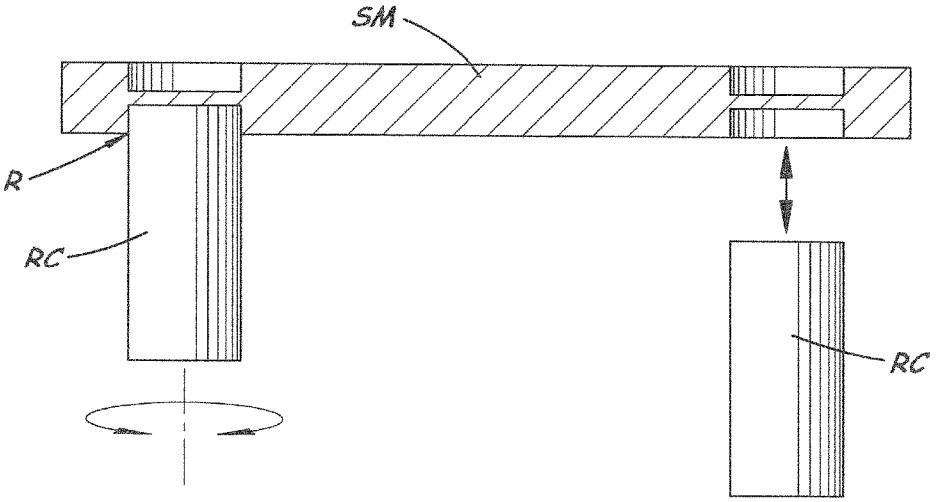
FIG. 33 is a front, cross-sectional view of an embodiment of an intermediate support member with example columns (not shown in cross-section) that are detachably and rotatably fit to the support member, such as in the pedestals of FIGS. 16-24.
Figure 34:
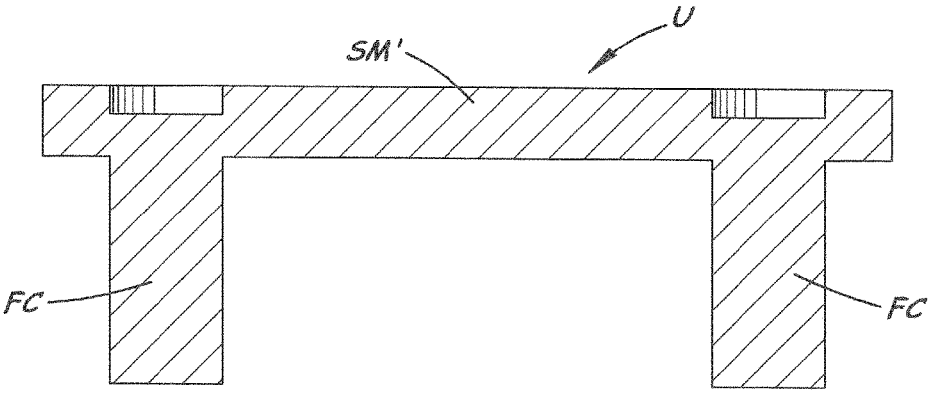
FIG. 34 is a front, cross-sectional view of an embodiment of a support-with-fixed columns unit, wherein two columns are integrally formed with, or otherwise fastened permanently, to the support member, wherein the columns are not detachable or rotatable relative to the support member, but the unit as a whole may rotate relative to a portion of another support unit and/or rotatable column.
Figure 35:
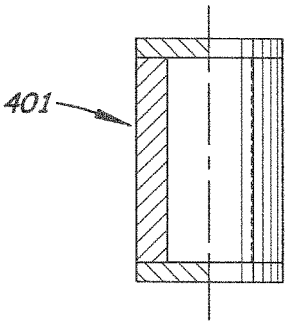
FIGS. 35-39 are partial-cross-sectional front views of alternative columns for certain embodiments of the invented pedestal.
Figure 37:
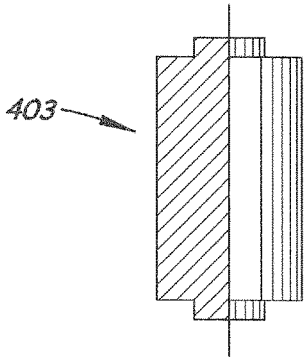
Figure 36:
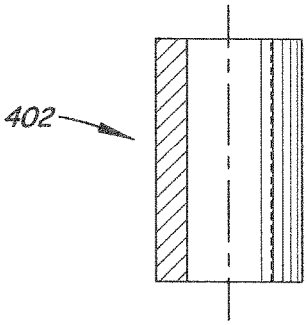
Figure 38:
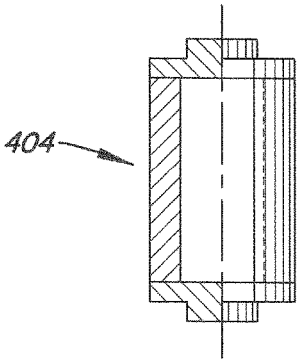
Figure 40:
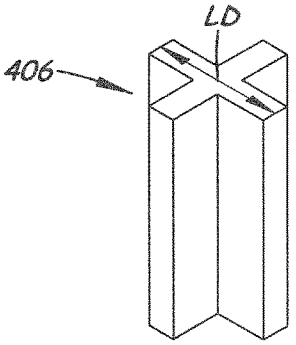
FIGS. 40 and 41 are front perspective views of additional, alternative columns for certain embodiments of the invented pedestal.
Figure 39:
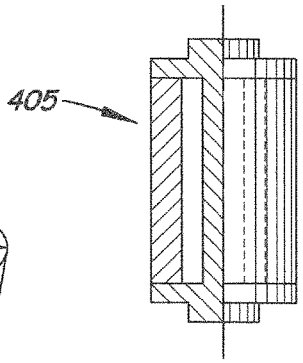
Figure 41:
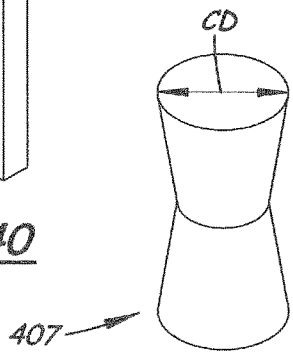

It will be understood from this disclosure that the columns of each of FIGS. 25-32, and also of pedestals 10, 100, 200, 300, are preferably detachably and/or rotatably engaged with the portrayed support members. However, alternatively, the columns in FIGS. 25-32 and pedestals 10, 100, 200, 300 may be fixed to their respective support members, for example, by integral formation, by adhesive, by welding, by fasteners, or by other fixing means. FIGS. 33 and 34 illustrate certain embodiments of these options. FIG. 33 shows a removable column RC vertically sliding into a bottom recess of the support member SM, resulting in a column and support member engagement that is detachable, rotatable, and preferably held together or "secured" only by gravity. Thus, the resulting connections of the two columns (illustrated as connection R at the opposite-end column) allow for easy reconfiguration of a pedestal, including rotation relative to the column(s), and/or switching out one or both of the columns for a longer or shorter columns to match the requirements of where the support member is placed in the pedestal. FIG. 34 illustrates a unit U having the support member SM' and two columns FC fixed together, wherein the columns will not rotate relative to, or detach from, the support member. Such a unit U may be used in some pedestals and in changing configurations of the pedestal, with the unit as a whole being rotated and/or lifted and replaced in alternative positions. A drawback of such fixed units is that, unlike the detachable, non-fixed columns, the columns of unit U cannot be removed or changed to columns of other lengths. This drawback either 1) limits the pedestal configurations that can be made and/or 2) it requires the user to have more styles of units to create the same number of configurations. For example, for the second case, the user would need many units in order to provide all the combinations of recess numbers and column lengths.

The columns shown in pedestals 10, 100, 200, 300 are drawn as cylindrical and it will be understood that they may be solid, partially-hollow, or hollow, and may be made of various materials, such as metal, aluminum, composite, wood, cardboard, paper, polymer, recycled or new materials, other materials, or combinations of these materials. FIGS. 35-41 illustrate some, but not all, alternative columns that may be used in certain embodiments of pedestals. Column 401 is a cylindrical, hollow column, having end caps that close/cover the ends of the column. Column 402 is a hollow cylinder without endcaps, or a "tube". Column 403 is a solid column with protrusions from each end at the center axis of the column. Column 404 is a hollow cylindrical column with endcaps that comprise a similar protrusion as that in column 403 at the center axis of the column. Column 405 has a tubular outer shell, and endcaps that are connected by an axially-extending connector that extends all the way through the tubular outer shell to retain the endcaps on the tubular outer shell. Column 406 is a non-cylindrical, non-tubular column that is in the form of an X-shape having four arms of the same length (measured transverse to the axial length of the column). Like the other columns drawn here, the ends of column 406 could each be vertically slidable into a recess in a support member and could rotate in the recess, for example, if the recess is cylindrical and of at least the diameter equal to the largest effective diameter LD. Column 407 is a shape that includes two truncated cones end-to-end, wherein each end of the column is circular and could vertically slide into and rotate in a recess with a diameter at least at large as the diameter of each end CD.

Columns other than those drawn could be used. For example, columns could be used that have other axial, outer sidewall shapes, and/or decorations, and/or mesh or aperture-containing portions, and/or other endcaps or other endcaps attachments. For example, endcaps on a tubular main body may include a lip extending over the end surface of the tubular main body and down part way along the axial outer surface of the main body. It will noted that the ends of the columns may be non-circular and/or non-uniform and may still rotatably engage a support member. Also, it will be understood from the drawings that various diameters of columns, or column protrusions, may be used, and cooperating recesses/depressions may be designed accordingly, wherein the recesses/depressions supply at least some horizontal/sideways retention of the column in the recess to prevent or limit the support members from sliding horizontally/sideways relative to the columns. For example, an annular recess may be provided for tubular columns without endcaps.

In certain less-preferred embodiments, the columns of FIGS. 25-32 and/or other columns and support member combinations may be rotatably connected by other means than a slidable and removable engagement. For example, the columns may be attached by a fastener that allow at least some rotation but that prevents the column from separating from the support member, for example, under any circumstances, unless a tool is used, or unless a manually-actuated latch or lock is unlatched/unlocked.

Thus, it may be understood from this description and drawings that pedestals may be made and used that comprise multiple interconnected layers of support members that are spaced apart in height by columns (or alternatively "risers") of one or more heights, preferably that include at least one or some rotatable and or detachable engagement of the columns with the support members. In some embodiments, some of the columns are fixed to the support members, for example, the columns depending from a given support members being fixed to that support member, but not fixed to any support member below said columns of said given support member.

From FIGS. 16-24 and the above discussion, it will be understood that the columns, or the columns and portions of intermediate support members, form vertical pillars (or, alternatively, generally vertical pillars) for lifting, spacing, and supporting the various layers of the pedestals. For example, referring to both FIGS. 17 and 18, one may see the following. Columns C1 and C3 plus an end portion of B1 form a vertical pillar; support members B1 and A1 are supported (partially) by that vertical pillar. Columns C4, C5, and C6 plus an end portion of each of A3 and A1 form a vertical pillar; support members A3, A1, and top support member A2 are supported (partially) by that vertical pillar. Columns C8 and C9 and an opposite end of A3 form a vertical pillar; support members A3 and A4 are supported (partially) by that vertical pillar. Columns C10 and C11 plus an end portion of A4 form a vertical pillar; support member A4 and top support member A5 are supported (partially) by that vertical pillar. Columns C10 and C11 plus an end portion of A4 form a vertical pillar; support member A4 and top support member A5 are supported (partially) by that vertical pillar. Columns C16 and C18 plus an end portion of A7 form a vertical pillar; support members A7 and A6 are supported (partially) by that vertical pillar. Column C17 may also be called a vertical pillar consisting of a single column.

When the pedestal components of pedestal 10 are rotated to form pedestal 100, the vertical pillars remain the same, including the same composition (same components) and supporting the same support members. With rotation, the support members may extend in different directions from the vertical pillars, but the functional support relationship of the support members with the vertical pillars does not change. If pedestal components are switched, deleted, or added, the vertical pillars composition and function may change due to the change in components.

In pedestal 200, as shown best in FIG. 22, a vertical pillar P1 of two different-length columns and an end of A1 partially supports A1 and A4. A vertical pillar P2 of five single-length columns and ends of A2, A3, A4, and A5 partially supports A2-A5 and partially supports top support member A6. Similarly, vertical pillar P3 of five single-length columns and ends of A5, A7, A8, and A9 partially supports A5, A7, A8, A9 and partially supports top support member A6. Vertical pillar P4 of five single-length columns and ends of A10, A11, A7 and A12 partially supports A10, A11, A7 and A12 and partially supports top support member A13. Vertical pillar P5 of two double-length columns, a single-length column, and ends of A14, A12, partially supports A14, A12 and partially supports top support member A13. The columns under the outer ends of A1, A2, A3, A8, A9, A10, A11, and A14 each could be called a single-column vertical pillar partially-supporting their respective support member ends. It may be noted that of the support members listed in this paragraph, all may be called "intermediate support members" except for the continuously-planar-top-surface uppermost-layer support members A13 and A6 that are called "top support members".

Although this invention has been described above with reference to particular means, materials and embodiments, it is to be understood that the invention is not limited to these disclosed particulars, but extends instead to all equivalents within the scope of the following claims.

The invention claimed is:

1. A pedestal system for displaying food and other objects in an elevated position above a platform or a table, the pedestal system comprising:

a horizontally-elongated top support member having a first end and a second end and a length between said first and second ends;

wherein the top support member is supported at the first end by a first pillar comprising a vertically-elongated upper column and a vertically-elongated lower column, and an inner end of a single horizontal first intermediate support member that is located between said upper column and said lower column, wherein said upper column rotatably and detachably rests in a recess in an upper surface of the first intermediate support member at said inner end, and the first intermediate support member has a lower surface with a recess that rotatably and detachably rests on said lower column, wherein the recesses are coaxial and separated by a horizontal barrier structure so that said upper column and said lower column do not contact each other, so that the first intermediate support member is rotatable relative to said upper column and said lower column for adjusting position of the first intermediate support member relative to the top support member; and wherein the top support member is supported at the second end by a second pillar comprising at least one column wherein said first intermediate support member is horizontally-elongated and has an outer end, opposite said inner end, that is supported by a third pillar comprising a vertically-elongated upper column and a vertically-elongated lower column, and an inner end of a single horizontal second intermediate support member that is located between said upper and lower columns of said third pillar;

wherein said upper column of the third pillar rotatably and detachable rests in a recess in an upper surface of said second intermediate support member at said inner end of the second intermediate support member, and the second intermediate support member has a lower surface with a recess that rotatably and detachable rests on the lower column of the third pillar, and wherein the recesses of the second intermediate support member are coaxial and separated by a horizontal barrier structure of the second intermediate support member, so that the upper column and the lower column of the third pillar do not contact each other, and so that the second intermediate support member is rotatable relative to said upper column and said lower column of the third pillar for adjusting position of the second intermediate support relative to the first intermediate support member;

wherein the second intermediate support member has an outer end that is supported by a fourth pillar comprising a vertically-elongated column;

wherein lengths of all of the upper and lower columns of the first pillar, the at least one column of the second pillar, the upper and lower column of the third pillar, and the column of the fourth pillar are selected from a group consisting of three different lengths; and wherein the upper and lower columns of the first pillar are coaxial, and the upper and lower columns of the second pillar are coaxial;

wherein said top support member and first and second intermediate support members and said columns are secured in the pedestal only by gravity; and wherein the top support member has an upper surface without any recess and without any column extending up from the top support member upper surface; and wherein the first intermediate support member upper surface, and the second intermediate support member upper surface, each has only a single recess that is said recess in which the upper column of the first pillar and the upper column of the third column rotatably rests, respectively, so that the upper columns of the first pillar and the third pillar are the only columns extending upward from the first and second intermediate support members, respectively.

2. The pedestal system of claim 1, wherein each of the first and second intermediate support members has a longitudinal axis, the second intermediate support member is rotatable 360 degrees relative to the upper and lower columns of the third pillar in a horizontal plane, to place the longitudinal axis of the second intermediate support member at any angle to the longitudinal axis of the first intermediate support member.

3. The pedestal system of claim 1, further comprising each of the top support member and the first intermediate support member having an upper surface, and the upper surfaces of the top support member and the first and second intermediate support members removably receiving at least one display item selected from the group consisting of: tableware, foodstuffs, serving dishes, containers, platters, trays, jugs, glasses, bottles, cutlery, ice sculptures, flowers, flower vases, flower pots, jewelry, toiletries, cosmetics, computer equipment, computer equipment, merchandise for sale, and decorations.

4. A pedestal system comprising a horizontally-elongated first top support member and a horizontally-elongated second top support member, multiple pillars comprising columns, and multiple, horizontally-elongated intermediate support members;

wherein:

the first top support member and the second top support member are each supported at top ends of two of said pillars;

each end portion of each intermediate support member is received and supported between pairs of upper and lower columns of two of said pillars, so that only one end portion is between each pair of upper and lower columns; and bottom ends of all of said pillars rest on a horizontal platform surface;

wherein at least one of said intermediate support members extends between and is supported by one of the pillars supporting said first top support member and one of the pillars supporting said second top support member;

all of the support members and columns are retained in the pedestal system by only gravity; and each of the first and second top support members has an uppermost surface comprising no recesses and comprising no columns extending up from said uppermost surface.

5. A pedestal system as in claim 4, wherein at least one of said intermediate support members extends between and is supported by the two pillars supporting the first top support member.

6. A pedestal system as in claim 4, wherein all of the columns rotatably and detachably engage said intermediate support members.

7. A pedestal system as in claim 4, wherein some but not all of the columns rotatably and detachably engage said intermediate support members.

8. A pedestal system as in claim 4, wherein the upper and lower columns, of each pair of upper and lower columns, are separated by a horizontal barrier structure so that no columns contact each other, and no columns extend through the first and second top support members and no columns extend through the intermediate support members.

9. A pedestal assembly for use on a table or other platform, the pedestal assembly comprising a plurality of modules each comprising a single horizontal support member having upper surface for displaying food and other objects and a lower surface, and two columns fixed to, and depending down from the lower surface of, the horizontal support member, said two columns of each module being selected from a group consisting of two columns of equal length, and two columns having unequal lengths; wherein the modules are stacked generally vertically to form the pedestal assembly and are all the modules are retained in the pedestal assembly by gravity only, and each module is rotatable relative to other modules in the pedestal assembly; wherein the modules comprise:

a bottom module in a bottom position in the pedestal assembly, with the two columns of the bottom module capable of contacting the platform;

an intermediate module in an intermediate position in the pedestal assembly, with one of the two columns of the intermediate module contacting the upper surface of, and being coaxial with one of the columns of, the bottom module and one of the two columns of the intermediate module capable of contacting the platform; and at least one top module in a top position in the pedestal assembly, with at least one of the two columns of the top module contacting the upper surface of, and being coaxial with one of the columns of, the intermediate module, and wherein no module and no column of a module extends up from the upper surface of the at least one top module.

* * * * *